US008455762B2

(12) United States Patent
Vexler et al.

(10) Patent No.: US 8,455,762 B2
(45) Date of Patent: Jun. 4, 2013

(54) HIGH PERFORMANCE TELECOMMUNICATIONS CABLE

(75) Inventors: Gavriel Vexler, Westmount (CA); Michel Bohbot, Neuily-sur-Seine (FR); Yves Dion, Ste-Julie (CA); Eric Humphrey, Laval (CA); Michel Richard, Kirkland (CA)

(73) Assignee: Belden CDT (Canada) Inc., Quebec (CA)

( * ) Notice: Subject to any disclaimer, the term of this patent is extended or adjusted under 35 U.S.C. 154(b) by 499 days.

(21) Appl. No.: 12/887,879

(22) Filed: Sep. 22, 2010

(65) Prior Publication Data

US 2011/0005806 A1 Jan. 13, 2011

Related U.S. Application Data

(63) Continuation of application No. 11/718,148, filed as application No. PCT/CA2005/001732 on Nov. 15, 2005, now Pat. No. 7,838,773.

(30) Foreign Application Priority Data

Nov. 17, 2004 (CA) ..... 2487777
Jan. 21, 2005 (CA) ..... 2493681

(51) Int. Cl.
*H01B 11/04* (2006.01)

(52) U.S. Cl.
USPC ..... 174/113 R; 174/113 C

(58) Field of Classification Search
USPC ..... 174/113 R, 113 C, 131 A
See application file for complete search history.

(56) References Cited

U.S. PATENT DOCUMENTS

| | | | |
|---|---|---|---|
| 483,285 | A | 9/1892 | Guilleaume |
| 514,925 | A | 2/1894 | Guilleaume |
| 1,008,370 | A | 11/1911 | Robillot |
| 1,977,209 | A | 10/1934 | Sargent |
| 2,583,025 | A | 1/1951 | Swift |
| 2,583,026 | A | 1/1952 | Swift et al. |
| 2,804,494 | A | 10/1954 | Fenton |

(Continued)

FOREIGN PATENT DOCUMENTS

| | | |
|---|---|---|
| CA | 2058046 | 8/1992 |
| DE | 697378 | 10/1940 |

(Continued)

OTHER PUBLICATIONS

McGettigan et al., "New Cable Construction to Improve Crosstalk and/or Attenuation", Northern Telecom, Jan. 17, 1991.

*Primary Examiner* — Chau Nguyen
(74) *Attorney, Agent, or Firm* — Lando & Anastasi, LLP

(57) ABSTRACT

A telecommunications cable comprising four twisted pairs of conductors and a separator spline comprised of a principal dividing strip and a first subsidiary dividing strip attached longitudinally along a first side of the principal dividing strip and a second dividing strip attached longitudinally along a second side of the principal dividing strip, the spline separating the four twisted pairs such that they are arranged in a staggered configuration. A method for reducing cross talk between adjacent cables in a telecommunications system, the method comprising the steps of, for each of the cables, providing a plurality of twisted pairs of conductors, winding an elongate filler element around the twisted pairs and covering the twisted pairs and the element with a cable jacket, the element introducing a visible distortion into an outer surface of the jacket.

18 Claims, 17 Drawing Sheets

U.S. PATENT DOCUMENTS

| | | | | |
|---|---|---|---|---|
| 3,055,967 | A | 9/1962 | Bondon | |
| 3,259,687 | A | 7/1966 | Oatess et al. | |
| 3,350,647 | A | 10/1967 | Gabriel et al. | |
| 3,361,871 | A | 1/1968 | Brandt | |
| 3,363,047 | A | 1/1968 | Grove | |
| 3,603,715 | A | 9/1971 | Eilhardt et al. | |
| 3,622,683 | A | 11/1971 | Roberts et al. | |
| 3,662,367 | A | 5/1972 | De Veau, Jr. et al. | |
| 3,678,177 | A | 7/1972 | Lawrenson | |
| 3,715,877 | A | 2/1973 | Akachi | |
| 4,401,845 | A | 8/1983 | Odhner et al. | |
| 4,456,331 | A | 6/1984 | Whitehead et al. | |
| 4,604,862 | A | 8/1986 | McGettigan et al. | |
| 4,644,098 | A | 2/1987 | Norris et al. | |
| 4,697,051 | A | 9/1987 | Beggs et al. | |
| 4,777,325 | A | 10/1988 | Siwinski | |
| 4,804,702 | A | 2/1989 | Bartoszek | |
| 4,892,442 | A | 1/1990 | Shoffner | |
| 4,941,729 | A | 7/1990 | Hardin et al. | |
| 4,987,394 | A | 1/1991 | Harman et al. | |
| 5,107,076 | A | 4/1992 | Bullock et al. | |
| 5,132,488 | A | 7/1992 | Tessier et al. | |
| 5,180,884 | A | 1/1993 | Aldissi | |
| 5,212,350 | A | 5/1993 | Gebs | |
| 5,216,204 | A | 6/1993 | Dudek et al. | |
| 5,238,328 | A | 8/1993 | Adams et al. | |
| 5,434,354 | A | 7/1995 | Baker et al. | |
| 5,486,649 | A | 1/1996 | Gareis | |
| 5,486,654 | A | 1/1996 | Hanak et al. | |
| 5,666,452 | A | 9/1997 | Deitz, Sr. et al. | |
| 5,670,748 | A | 9/1997 | Gingue et al. | |
| 5,789,711 | A | 8/1998 | Gaeris et al. | |
| 5,796,046 | A | 8/1998 | Newmoyer et al. | |
| 5,956,445 | A | 9/1999 | Deitz, Sr. et al. | |
| 5,969,295 | A | 10/1999 | Boucino et al. | |
| 5,990,419 | A | 11/1999 | Bogese, II | |
| 6,074,503 | A | 6/2000 | Clark et al. | |
| 6,140,587 | A | 10/2000 | Sackett | |
| 6,150,612 | A | 11/2000 | Grandy et al. | |
| 6,162,992 | A | 12/2000 | Clark et al. | |
| 6,222,130 | B1 | 4/2001 | Gareis et al. | |
| 6,248,954 | B1 | 6/2001 | Clark et al. | |
| 6,297,454 | B1 | 10/2001 | Gareis | |
| 6,303,867 | B1 | 10/2001 | Clark et al. | |
| 6,318,062 | B1 | 11/2001 | Doherty | |
| 6,365,836 | B1 | 4/2002 | Blouin et al. | |
| 6,379,175 | B1 | 4/2002 | Reede | |
| 6,462,268 | B1 | 10/2002 | Hazy et al. | |
| 6,566,607 | B1 | 5/2003 | Walling | |
| 6,596,944 | B1 | 7/2003 | Clark et al. | |
| 6,639,152 | B2 | 10/2003 | Glew et al. | |
| 6,687,437 | B1 | 2/2004 | Starnes et al. | |
| 6,743,983 | B2 | 6/2004 | Wiekhorst et al. | |
| 6,787,697 | B2 | 9/2004 | Stipes et al. | |
| 6,800,811 | B1 | 10/2004 | Boucino | |
| 6,812,408 | B2 | 11/2004 | Clark et al. | |
| 6,855,889 | B2 | 2/2005 | Gareis | |
| 6,875,928 | B1 | 4/2005 | Hayes et al. | |
| 6,998,537 | B2 | 2/2006 | Clark et al. | |
| 7,015,397 | B2 | 3/2006 | Clark | |
| 7,064,277 | B1 | 6/2006 | Lique et al. | |
| 7,098,405 | B2 | 8/2006 | Glew | |
| 7,115,815 | B2 | 10/2006 | Kenny et al. | |
| 7,135,641 | B2 | 11/2006 | Clark | |
| 7,145,080 | B1 * | 12/2006 | Boisvert et al. | 174/110 R |
| 7,154,043 | B2 | 12/2006 | Clark | |
| 7,157,644 | B2 | 1/2007 | Lique et al. | |
| 7,173,189 | B1 | 2/2007 | Hazy et al. | |
| 7,179,999 | B2 | 2/2007 | Clark et al. | |
| 7,196,271 | B2 | 3/2007 | Cornibert et al. | |
| 7,197,291 | B2 | 3/2007 | Mach et al. | |
| 7,208,683 | B2 | 4/2007 | Clark | |
| 7,214,880 | B2 | 5/2007 | Wiekhorst et al. | |
| 7,214,884 | B2 | 5/2007 | Kenny et al. | |
| 7,220,918 | B2 | 5/2007 | Kenny et al. | |
| 7,238,885 | B2 | 7/2007 | Lique et al. | |
| 7,244,893 | B2 | 7/2007 | Clark | |
| 7,256,351 | B2 | 8/2007 | Dillon et al. | |
| 7,271,342 | B2 | 9/2007 | Stutzman et al. | |
| 7,317,163 | B2 | 1/2008 | Lique et al. | |
| 7,329,815 | B2 | 2/2008 | Kenny et al. | |
| 7,339,116 | B2 | 3/2008 | Gareis et al. | |
| 7,358,436 | B2 | 4/2008 | Dellagala et al. | |
| 7,390,971 | B2 | 6/2008 | Jean et al. | |
| 7,399,937 | B2 | 7/2008 | Nishimura | |
| 7,405,360 | B2 | 7/2008 | Clark et al. | |
| 7,449,638 | B2 | 11/2008 | Clark et al. | |
| 7,462,782 | B2 | 12/2008 | Clark | |
| 7,491,888 | B2 | 2/2009 | Clark | |
| 7,498,518 | B2 | 3/2009 | Kenny et al. | |
| 7,507,910 | B2 | 3/2009 | Park et al. | |
| 7,534,964 | B2 | 5/2009 | Clark et al. | |
| 7,612,289 | B2 | 11/2009 | Lique et al. | |
| 7,622,680 | B2 | 11/2009 | Bricker et al. | |
| 7,705,244 | B2 | 4/2010 | Fok | |
| 7,772,494 | B2 | 8/2010 | Vexler et al. | |
| 2003/0230427 | A1 | 12/2003 | Gareis | |
| 2005/0133246 | A1 | 6/2005 | Parke et al. | |
| 2005/0279528 | A1 | 12/2005 | Kenny et al. | |
| 2006/0032660 | A1 | 2/2006 | Parke et al. | |
| 2007/0044994 | A1 | 3/2007 | Park et al. | |
| 2008/0041609 | A1 | 2/2008 | Gareis et al. | |
| 2008/0164049 | A1 | 7/2008 | Vexler et al. | |
| 2009/0133895 | A1 | 5/2009 | Allen | |
| 2009/0173514 | A1 | 7/2009 | Gareis | |

FOREIGN PATENT DOCUMENTS

| | | | |
|---|---|---|---|
| EP | 0380245 | B1 | 8/1990 |
| EP | 0802545 | | 10/1997 |
| EP | 0961296 | | 12/1999 |
| EP | 1215688 | A1 | 9/2003 |
| EP | 1548754 | A2 | 6/2005 |
| FR | 2706068 | | 12/1994 |
| GB | 725624 | | 3/1955 |
| GB | 2355335 | A | 4/2001 |
| JP | S2915973 | | 12/1955 |
| JP | S511976-33331 | | 8/1976 |
| JP | 4332406 | | 11/1992 |
| JP | 2000011774 | A | 1/2000 |
| JP | 2001-023454 | A | 1/2001 |
| JP | 2001028208 | A | 1/2001 |
| JP | 2001-273822 | A | 10/2001 |
| JP | 2002042581 | A | 2/2002 |
| JP | 2002117730 | A | 4/2002 |
| JP | 2002512420 | A | 4/2002 |
| JP | 2002157296 | A | 5/2002 |
| JP | 2002367446 | A | 12/2002 |
| JP | 2003-521089 | A | 7/2003 |
| JP | 2003217362 | A | 7/2003 |
| JP | 2003323821 | A | 11/2003 |
| JP | 2004-311120 | | 11/2004 |
| JP | 2006-127930 | A | 5/2006 |
| JP | 2007-511048 | A | 4/2007 |
| NL | 8202627 | | 1/1984 |
| WO | 03077265 | A1 | 9/2003 |

* cited by examiner

HIGH PERFORMANCE TELECOMMUNICATIONS CABLE

BACKGROUND

1. Field of Invention

The present invention relates to a high performance telecommunications cable. In particular, the present invention relates to a cable designs designed to reduce PSANEXT.

2. Discussion of Related Art

The introduction of a new IEEE proposal for 10 G (Gigabit per second) transmission speeds over copper cable has spearheaded the development of new copper Unshielded Twisted Pair (UTP) cable designs capable to perform at this speed.

As known in the art, such UTP cables typically consist of four twisted pairs of conductors each having a different twist lay. Additionally, in many installations, a number of UTP cables are arranged in cable runs such that they run side by side and generally in parallel. In particular, in order to simplify the installation of UTP cables in cable runs, EMC conduit, patch bays or the like, a number of UTP cables are often bound together using ribbon, twist ties, tape or the like. A major technical difficulty in such installations is the electromagnetic interference between the twisted pair conductors of a "victim" cable and the twisted pair conductors of other cables in the vicinity of the victim cable (the "offending" cables). This electromagnetic interference is enhanced by the fact that, in 10 G systems where all twisted pairs of the UTP cable are required to support the high speed transmission, all conductors in a first cable are the "victims" of the twisted pair conductors of all other cables surrounding that first cable. These like pairs, having the same twisting lay, act as inductive coils that generate electromagnetic interference into the conductors of the victim cable. The electromagnetic interference, or noise, generated by each of the offending cables into the victim cable is generally known in the art as Alien Cross Talk or ANEXT. The calculated overall effect of the ANEXT into the victim cable is the Power Sum ANEXT or PSANEXT.

ANEXT and PSANEXT are important parameters to minimize as active devices such as network cards are unable to compensate for noise external to the UTP cable to which it is connected. More particularly, active systems at receiving and emitting ends of 10 G Local Area Networks are able to cancel internal Cross Talk (or NEXT) but cannot do the same with ANEXT. This is also due to some degree in the relatively high number of calculations involved if it is wished to compensate for ANEXT (up to 24 emitting pairs in ANEXT calculations vs. 3 emitting pairs in NEXT calculations).

In order to reduce the PSANEXT to the required IEEE draft specification requirement of 60 dB at 100 MHz, cable designers typically manipulate a few basic parameters that play a leading role in the generation of electromagnetic interference between cables. The most common of these are:

Geometry: (1) The distance between pairs, longitudinally, in adjacent cables; (2) the axial X-Y asymmetry of the pairs a cable cross-section; and (3) the thickness of the jacket; and Balance: improved balance of the twisted pairs and of the overall cable is known to reduce emission of electromagnetic interference and increase a cable's immunity to electromagnetic interference.

Currently, the only commercial design of a 10 G cable incorporates a special cross web or spline which ensures that the twisted pairs of conductors are arranged off centre within the cable jacket. Additionally, this prior art cable incorporates twisted pairs with very short twisting lays and stranding lays that are known to enhance the balance of the twisting lays.

SUMMARY OF THE INVENTION

To address the above and other drawbacks there is disclosed a separator spline for use in a telecommunications cable. The spline comprises a principal dividing strip comprised of a middle strip and first and second outer strips and first and second subsidiary dividing strips attached longitudinally along the principal strip and on opposite sides thereof. A point of attachment of the first subsidiary strip is between the middle strip and the first outer strip and a point of attachment of the second subsidiary strip is between the second outer strip and the middle strip.

There is also disclosed a telecommunications cable comprising four twisted pairs of conductors and a separator spline comprised of a principal dividing strip and a first subsidiary dividing strip attached longitudinally along a first side of the principal dividing strip and a second dividing strip attached longitudinally along a second side of the principal dividing strip, the spline separating the four twisted pairs such that they are arranged in a staggered configuration.

Furthermore, there is disclosed a telecommunications cable comprising a plurality of twisted pairs of conductors arranged around and running along an axis and a cable jacket surrounding the twisted pairs, the jacket comprising an outer surface. The outer surface defines a tube having a helical centre path arranged around and running along the axis.

Additionally, there is disclosed a telecommunications cable comprising a plurality of twisted pairs of conductors arranged around and running along a first axis and a cable jacket surrounding the twisted pairs, the jacket comprising a protrusion arranged around and running along the jacket. The protrusion is arranged helically around the first axis.

Also, there is disclosed a telecommunications cable comprising a first set of two twisted pairs of conductors arranged on opposite sides of and running along an axis and a second set of two twisted pairs of conductors on opposite sides of and running along the axis. A first flat surface bounded by the first set and a second flat surface bounded by the second set intersect along the axis at an oblique angle.

There is further disclosed a telecommunications cable comprising a first set of two twisted pairs of conductors arranged on opposite sides of and running along an axis and separated by a first distance and a second set of two twisted pairs of conductors on opposite sides of and running along the axis and separated by a second distance less than the first distance. Each of the first set of twisted pairs has a twist lay which is shorter than a twist lay of either of the second set of twisted pairs.

Additionally, there is disclosed a telecommunications cable comprising a plurality of twisted pairs of conductors, an elongate filler element wound helically around the twisted pairs along a length of the cable and a cable jacket covering the element and the twisted pairs.

Also, there is disclosed a telecommunications cable comprising a plurality twisted pairs of conductors and a cable jacket covering the twisted pairs. The cable jacket has a thickness which varies along a length of the cable.

Furthermore, there is disclosed a telecommunications cable comprising a plurality of in parallel twisted pairs of conductors, wherein each of the pairs has a constant twist lay and follows a helical path along the axis, the path having a variable pitch.

There is also disclosed a telecommunications cable comprising a first set of two parallel twisted pairs of conductors arranged on opposite sides of and wound helically around a first elongate path and a second set of two parallel twisted pairs of conductors arranged on opposite sides of and wound helically around a second elongate path. The helically wound first set has a radius greater than the helically wound second set.

Also, there is disclosed a telecommunications cable comprising a plurality of parallel pairs of conductors arranged along an axis, a cable jacket, the jacket when viewed in transverse cross section comprising an oblong part surrounding the helical pairs and a protruding part extending from an outer surface of the jacket. The oblong part rotates along the axis and the protruding part winds about the axis and further wherein a pitch of the winding protruding part is variable versus the rotation of the oblong part.

Additionally, there is disclosed a telecommunications cable comprising four twisted pairs of conductors arranged around and running along an axis wherein, when the cable is viewed in transverse cross section, a first distance separating a first of the twisted pairs and a second of the twisted pairs, the second pair and a fourth of the twisted pairs and the fourth pair, and a third of the twisted pairs is greater than a second distance separating the first pair and the fourth pair and the second pair and the third pair and less than a third distance separating the first pair and the third pair.

There is furthermore disclosed a method for manufacturing a telecommunications cable comprising steps of providing a plurality of twisted pairs of conductors arranged in parallel along an axis and winding the twisted pairs helically along the axis with a variable pitch. Each of the wound twisted pairs have a substantially constant twist lay.

Also, there is disclosed a method for fabricating a telecommunications cable comprising the steps of providing four twisted pairs of conductors and placing a separator spline between the twisted pairs, the spline comprising a principal dividing strip and a first subsidiary dividing strip attached longitudinally along a first side of the principal dividing strip and a second dividing strip attached longitudinally along a second side of the principal dividing strip, the spline separating the four twisted pairs such that they are arranged in a staggered configuration.

Furthermore, there is disclosed a method for reducing cross talk between adjacent cables in a telecommunications system, the method comprising the steps of, for each of the cables, providing a plurality of twisted pairs of conductors, winding an elongate filler element around the twisted pairs and covering the twisted pairs and the element with a cable jacket, the element introducing a visible distortion into an outer surface of the jacket.

BRIEF DESCRIPTION OF THE DRAWINGS

FIGS. 3A through 3D are transverse cross sections of a cable having a spline therein in accordance with alternative illustrative embodiments of the present invention;

DETAILED DESCRIPTION

Figure 1:
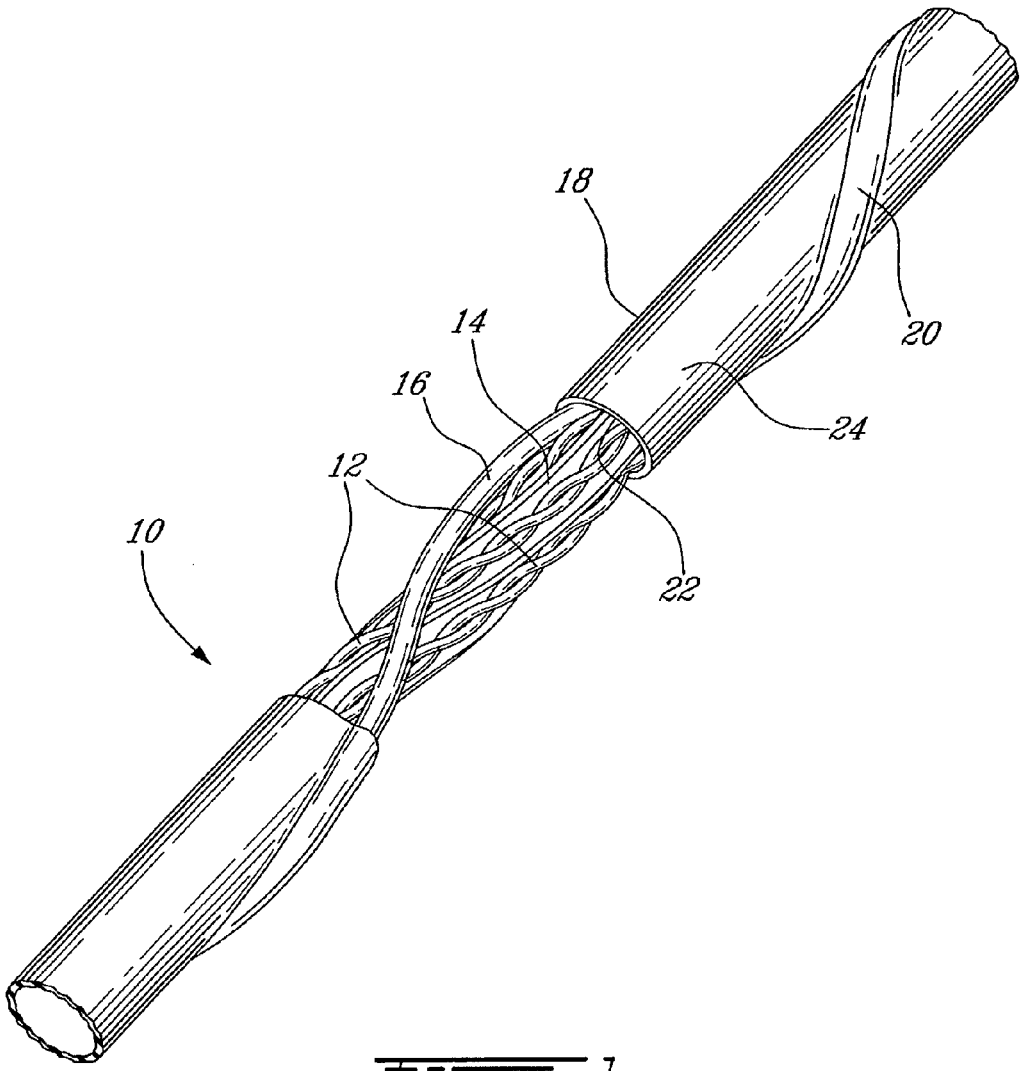
FIG. 1 is a cut away view of a telecommunications cable in accordance with an illustrative embodiment of the present invention.

Referring now to FIG. 1, a telecommunications cable, generally referred to using the reference numeral 10 will now be described. The cable 10 is comprised of four twisted pairs of conductors as in 12. Each twisted pair 12 is twisted with a constant or variable or random twist lay, and the twist lay of different pairs of conductors is typically different. A separator spline 14 is provided for maintaining a spacing between the four twisted pairs of conductors as in 12. As known in the art, the spline 14 is typically manufactured from a non-conductive material such as pliable plastic or the like. The twisted pairs as in 12 as well as the spline 14 are in turn illustratively stranded together such that as one moves along the cable 10 the twisted pairs as in 12 and the spline 14 rotate helically around an axis located along the centre of the cable 10. In this regard, the strand lay of the twisted pairs as in 12 and the spline 14 may be constant or variable or random.

Still referring to FIG. 1, a filler element 16 is illustratively wrapped around the twisted pairs 12 and the spline 14 and rests in between twisted pairs 12 and the spline 14 and the cable jacket 18. The filler element 16 illustratively is rod (cylindrical) shaped but may come in a variety of forms, for example square, tubular or comprising a series of flutes, or channels, moulded lengthwise therein. Additionally, although the filler element is typically manufactured from a non-conductive material, a conductive element may be included therein. The filler element 16 is typically wound about the twisted pairs 12 and spline 14 such that it is arranged helically around a centre path or axis defined by the cable 10. In order to prevent the filler element 16 from nesting into gaps which may form between the twisted pairs as in 14 the filler element 16 is illustratively wound in a direction which is opposite to that of the direction of strand lay of the twisted pairs 12 and the spline 14.

Still referring to FIG. 1, the filler element 16 must be of a thickness which is adequate to cause a distortion 20 in the cable jacket 18 surrounding the filler element 16. As will be seen below, when a cable as in 10 is held proximate to other cables, for example in a cable bundle or the like, the distortion as in 20 increases the gap between adjacent cables thereby improving performance. In order to decrease nesting between adjacent cables in such an implementation, it is preferable that the lay, or pitch, of the filler element 16 be different for adjacent cables. As this is often difficult to implement, the filler element 16 can be wound around the twisted pairs as in 14 such that its lay varies, in particular randomly.

In an alternative embodiment, and as will be discussed in more detail herein below the filler element 16 can also form part of the cable jacket 18, for example in the form of a protuberance on the inner surface 22 or outer surface 24 of the cable jacket. In a second alternative embodiment, and as will also be discussed in more detail herein below, the thickness of the cable jacket 18 can vary along the length as well as around the centre path of the cable 10 in order to achieve the same effect.

Figure 2A:
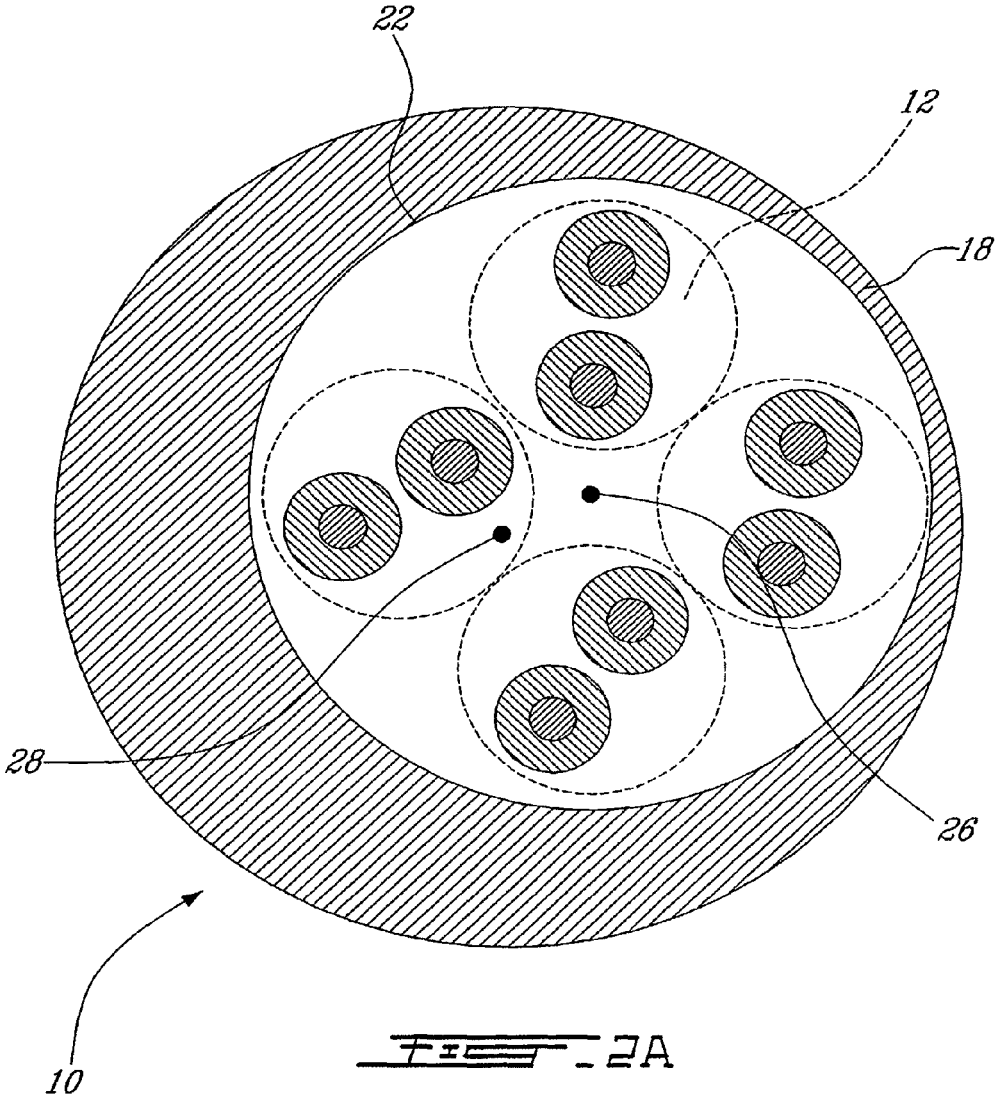
FIGS. 2A, 2B and 2C are transverse cross sections of a cable in accordance with illustrative embodiments of the present invention.
Figure 2B:
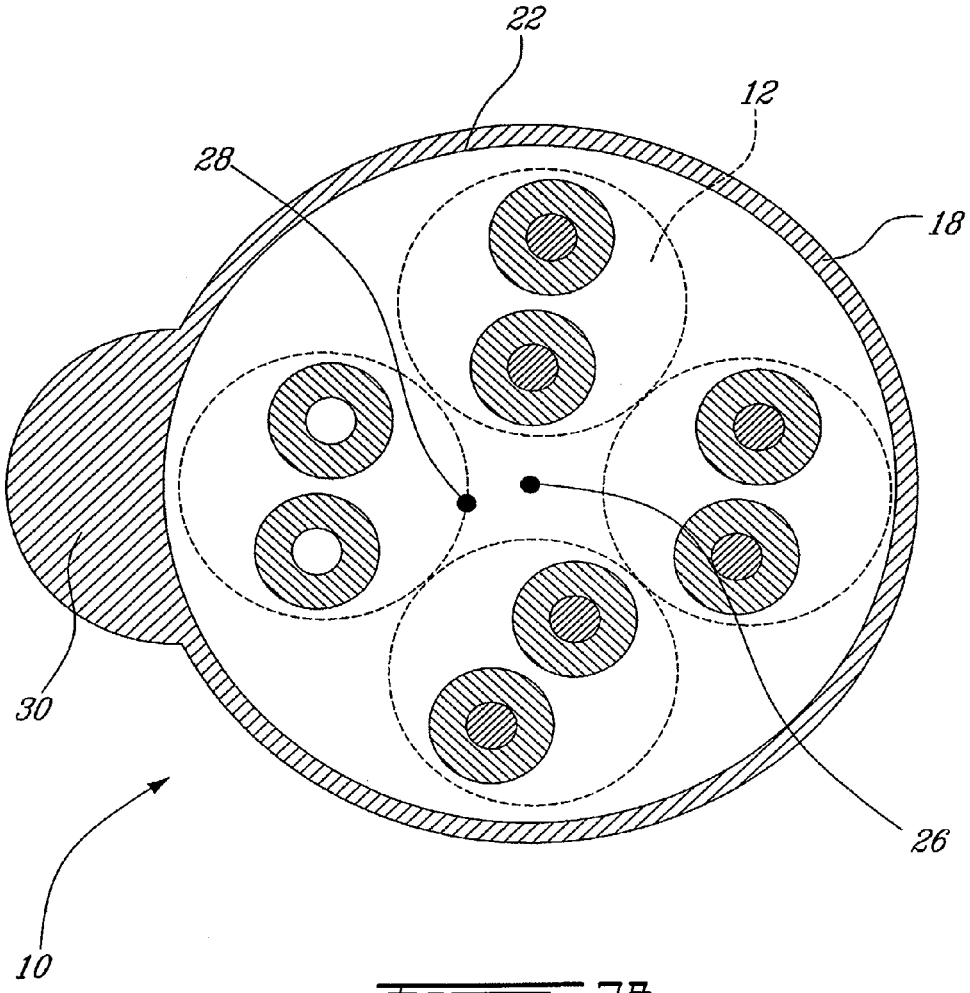
Figure 2C:
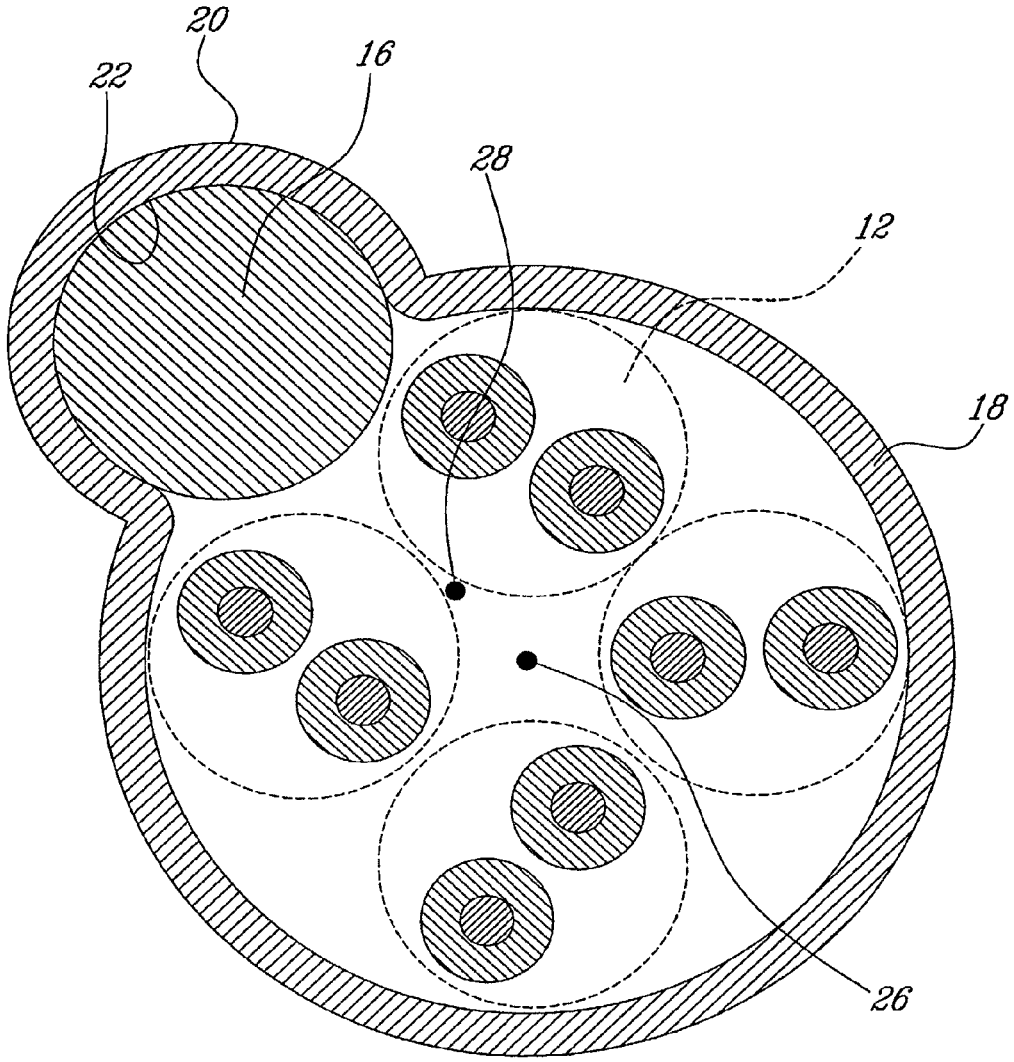

Referring now to FIGS. 2A, 2B and 2C, as discussed above, the cable 10 is generally comprised of a set of twisted pairs as in 12 and a cable jacket 18. The twisted pairs 12 are generally helically disposed about a primary cable axis 26, generally according to a standard fixed, variable or random strand lay. The outer surface 24 of the cable jacket 18, on the other hand, generally defines a tube having a centre path 28, such centre path 28 generally defined by the geometrical centre path or centroid of the cable cross section, that is helically twisted or wound about the axis 26. Consequently, though the inner surface 22 of the jacket 18 remains substantially parallel and collinear with the primary axis 26, the outer surface 24 of the jacket 18 provides a helically variable jacket thickness along the cable 10. This feature allows the cable 10 to provide a rotating asymmetric cross section that reduces ANEXT between adjacent cables, namely by both increasing and varying the distance between twisted pairs of adjacent cables. As will be discussed further herein below, such cable constructions also allow to reduce nesting between cables, providing additional performance with regards to ANEXT.

In the first illustrative embodiment of FIG. 2A, the twisted pairs 12 are conventionally disposed about the primary cable axis 26, whereas the cable jacket 18 is manufactured such that jacket material is asymmetrically distributed around the jacket defining the centre path 28 at the cable's geometrical centre or centroid that is offset from the primary axis 26. The uneven distribution of the jacket 18, and thereby the centre path 28, is helicoidally wound about the primary axis 26, which results in providing a cable as described above that reduces the effects of ANEXT with adjacent cables.

In FIG. 2B, a second illustrative embodiment of the present invention is presented. The cable 10 is comprised of the usual four (4) twisted pairs 12 disposed conventionally about the primary axis 26, and an eccentric jacket 18 defining a protuberance 30 at its outer surface. In this embodiment, the protuberance, or ridge, 30 is added to the outer surface 24 of the jacket 18, either externally coupled thereto or directly manufactured therein (for example, during the extrusion process), thereby again defining the centre path 28 centered at the geometrical centre or centroid of the cable 10 offset from the primary axis 26. The protuberance 30, and consequently the centre path 28, is wound helically about the primary axis of the cable 10 thereby again generating the desired effect.

In FIG. 2C, a third illustrative embodiment of the present invention is presented. In this embodiment, the twisted pairs 12 are disposed about the primary axis 26, and a filler element 16 (for example a solid rod or other filler material) is disposed helically about the twisted pairs 12. The cable jacket 18 confines the twisted pairs 12 and the filler element 16 therein. By winding the filler element 16 about the twisted pairs 12 and as discussed above, a distortion 20 is formed in the outer surface 24 of the jacket 18, defining once again the helically rotating path 28 centered at the helicoidally rotating geometrical centre or centroid of the cable 10. This third embodiment thus also produces the desired effect by providing a helically rotating cable cross section that reduces nesting and ANEXT between adjacent cables. Illustratively, as discussed above the filler element 16 is manufactured from a non-conductive dielectric material such as plastic, or the like, in either a solid or stranded form.

Consequently, cable cross section asymmetry is attainable using various jacket constructions. As illustrated in FIGS. 2A to 2C, adequate spacing between adjacent cables 10 may be attained to reduce nesting, and consequently ANEXT, by using helically rotating jacket asymmetries in cable manufacture. Necessarily, other such embodiments may be developed to produce the same effect. Namely, the distortion 20 in the cable jacket 18 of FIG. 1 may be produced by a filler element 16 wound directly around the twisted pairs 12 inside the cable jacket 18, within the cable jacket 18 or again on the outer surface of the cable jacket 18. Furthermore, protuberances of various cross sections, such as the illustrated circular, semi-circular and crescent cross sections of FIGS. 2A, 2B and 2C respectively, and other like protuberances of substantially square, rectangular, triangular or multiform cross section may also be considered.

In addition, as discussed above, in order to increase the potential benefits of such techniques, the secondary centre path 28 and the twisted pairs 12 of the above illustrative embodiments should be wound and twisted in opposite directions. Namely, a right-handed helical disposition of the twisted pairs around the first axis 26 should be coupled with a left-handed helical disposition of the jacket protuberance or asymmetry, or vice versa. Furthermore, by randomizing or varying the lay of these asymmetries and protuberances, rather than maintaining a fixed lay, nesting and ANEXT may be further reduced between adjacent cables 10.

Figure 3A:
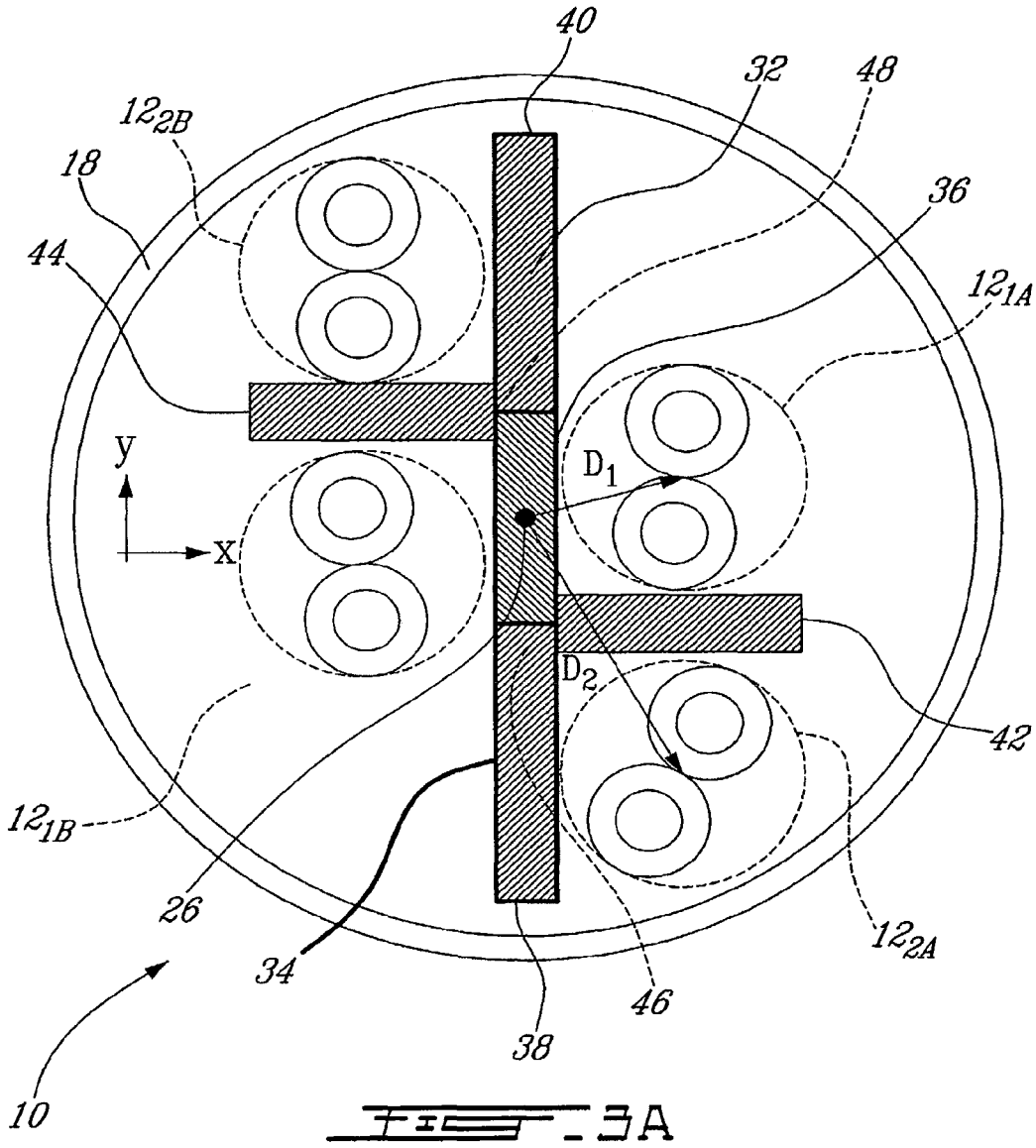

Referring now to FIG. 3A, an alternative illustrative embodiment of the present invention, where cable 10 is comprised of four (4) twisted pairs of insulated conductors as in 12 surrounded by a cable jacket 18 and separated by a separator spline 32, is disclosed. The spline 32 comprises a principal dividing strip 34 comprised of a middle strip 36 and first and second outer strips 38 and 40 respectively which, when viewed in transverse cross section, all lie in the same first plane. The spline 32 is further comprised of a first subsidiary dividing strip 42 (which, when the cable is viewed in transverse cross section, lies in a second plane) and second subsidiary dividing strip 44 (which, when the cable is viewed in transverse cross section, lies in a third plane) attached longitudinally along the principal strip 34 and on opposite sides thereof for maintaining a prescribed separation between twisted pairs $\mathbf{12}_{1A}$, $\mathbf{12}_{1B}$, $\mathbf{12}_{2A}$, $\mathbf{12}_{2B}$ and, in certain implementations, between the cable jacket 18 and twisted pairs as in 12.

Note that in certain implementations a cable jacket 18 is unnecessary with the cable consisting only of four twisted pairs of conductors as in 12 and a separator spline 32. In this regard the twisted pairs 12 may be bonded to the spline 32, or held in place by the mechanical forces generated by the twisting of the assembly and the filler element 16 which is wrapped around the twisted pairs 12 and the spline 32.

Still referring to FIG. 3A, first subsidiary dividing strip 42 and second subsidiary dividing strip 44 can be attached to the principal strip 34 in a given embodiment such that the second and third planes along which they lie when the cable is viewed in transverse cross section are either at right angles (as shown) or at an oblique angle to the first plane along which the principal strip 34 lies. Similarly, the second and third planes can be either in parallel (as shown) or at an oblique angle to one another.

Additionally, the thicknesses of the middle strip 36, first and second outer strips and/or the subsidiary dividing strips 42, 44 can all be the same or different.

Still referring to FIG. 3A, the first point of attachment 46 of the first subsidiary strip 42 is between the middle strip 36 and the first outer strip 38, and the second point of attachment 48 of the second subsidiary strip 44 is between the middle strip 36 and the second outer strip 40. The spline 32 improves the geometry of the cable 10 by creating an asymmetry on both the transverse X and Y-axes that translates into a helical pattern of the pairs in the Z direction, i.e. along the length of the cable 10. As a result, when the cable 10 is viewed in transverse cross section, the twisted pairs 12 are arranged relative to one another in a staggered configuration, or in other words there is no line about which a first set of two twisted pairs are the mirror image of a second set of two twisted pairs.

Figure 3B:
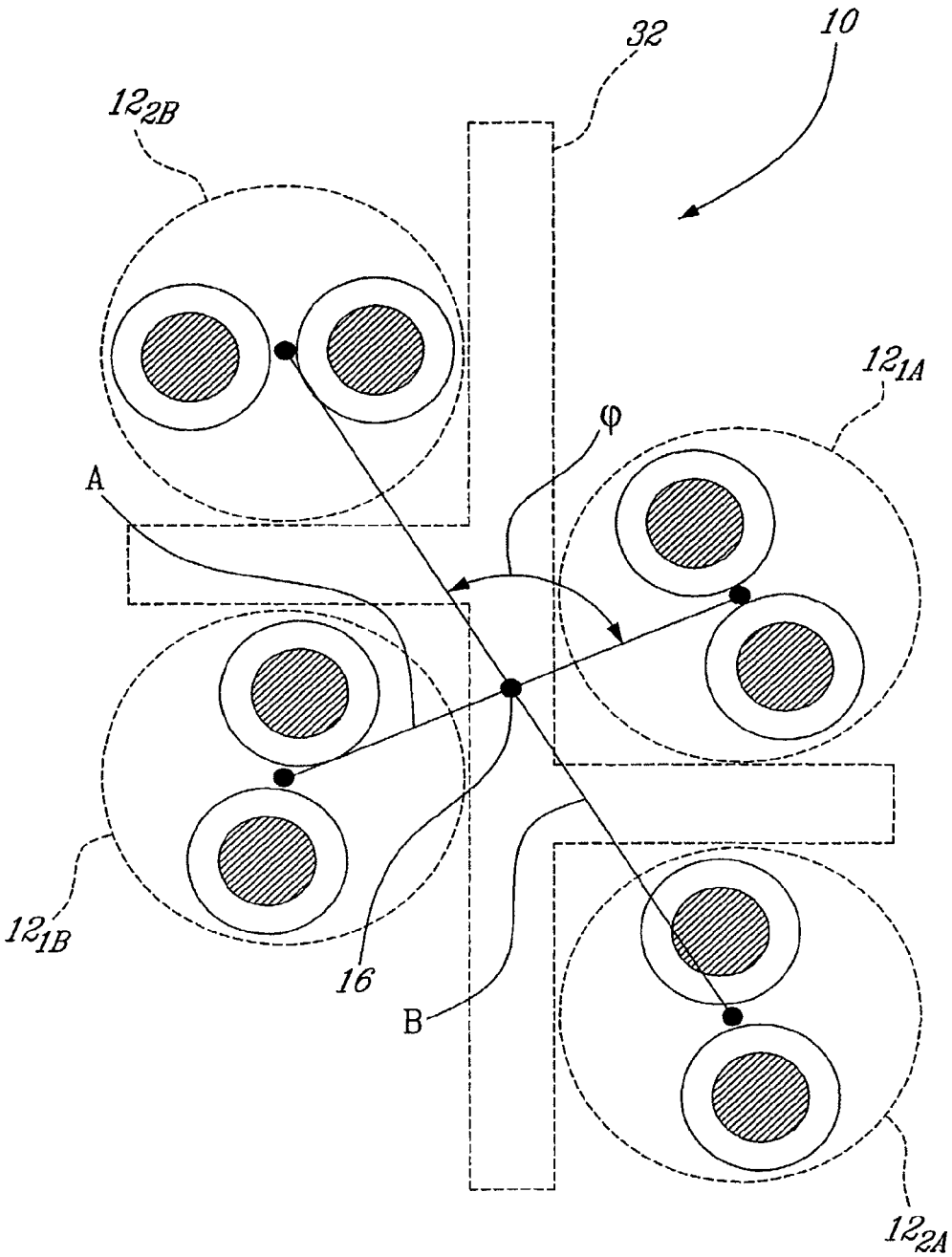

Referring now to FIG. 3B, the asymmetry introduced between the twisted pairs as in 12 by the separator spline 32 can be alternatively described as follows: Twisted pairs $\mathbf{12}_{1A}$ and $\mathbf{12}_{1B}$ bound a surface A which is centered on the primary axis 16 of the cable 10. Similarly, twisted pairs $\mathbf{12}_{2A}$ and $\mathbf{12}_{2B}$ bound a surface B which is also centered on the primary axis 16 of the cable 10. As the twisted pairs typically rotate helically along with the separator spline 32 along the length of the cable 10, the surfaces A, B also rotate as they are bounded by their respective twisted pairs $\mathbf{12}_{1A}$, $\mathbf{12}_{1B}$, $\mathbf{12}_{2A}$, $\mathbf{12}_{2B}$. When the cable 10 is viewed in transverse cross section as in FIG. 3B, at the point of intersection (which coincides with the primary axis 16 of the cable 10) surface A is maintained substantially at an angle Φ to surface B where Φ is oblique. In other words, surface A is not at right angles to surface B at their point of intersection. In a particular embodiment, surface A is at an angle of about 85° to surface B at their point of intersection.

Figure 3C:
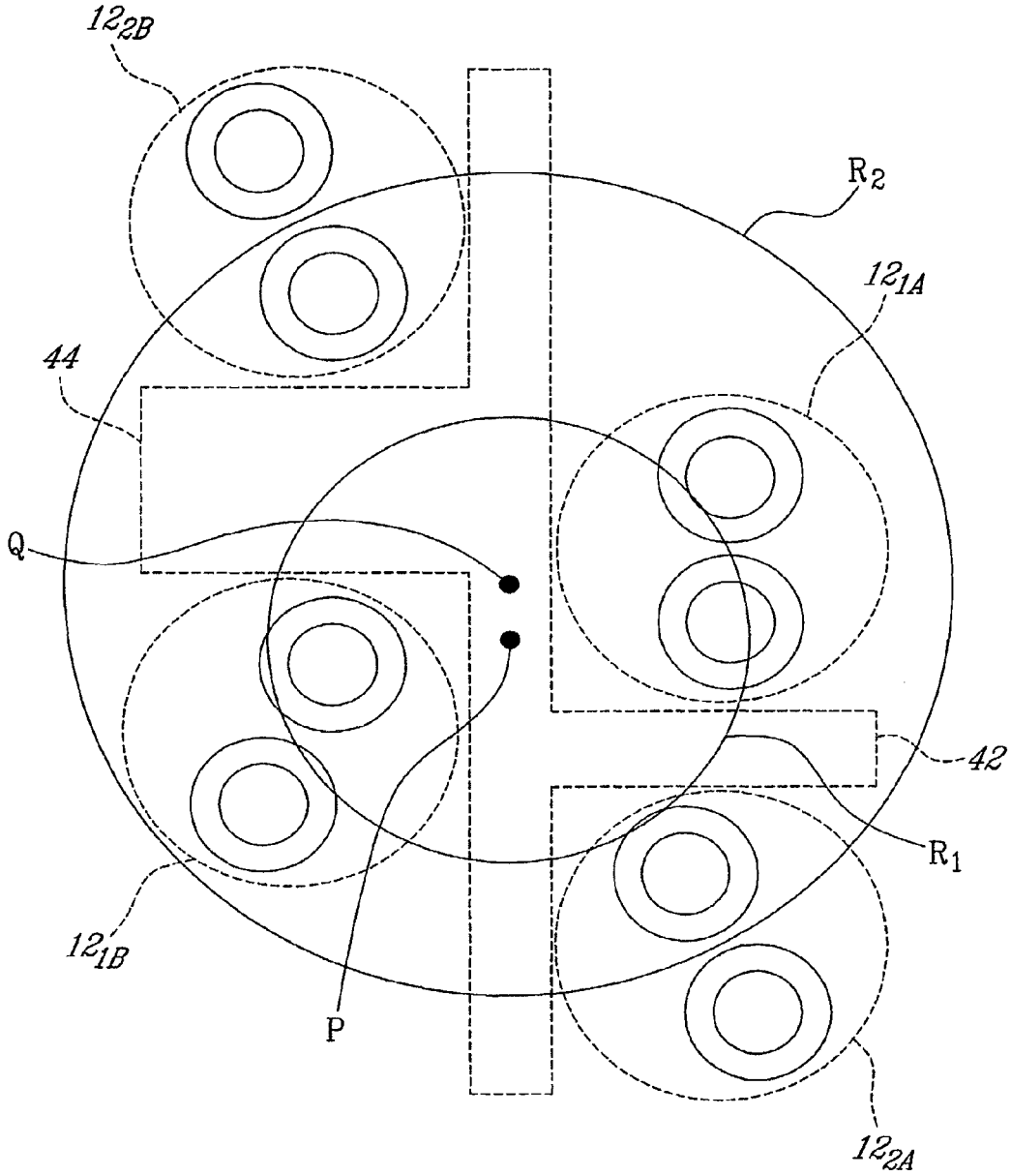
Figure 30:
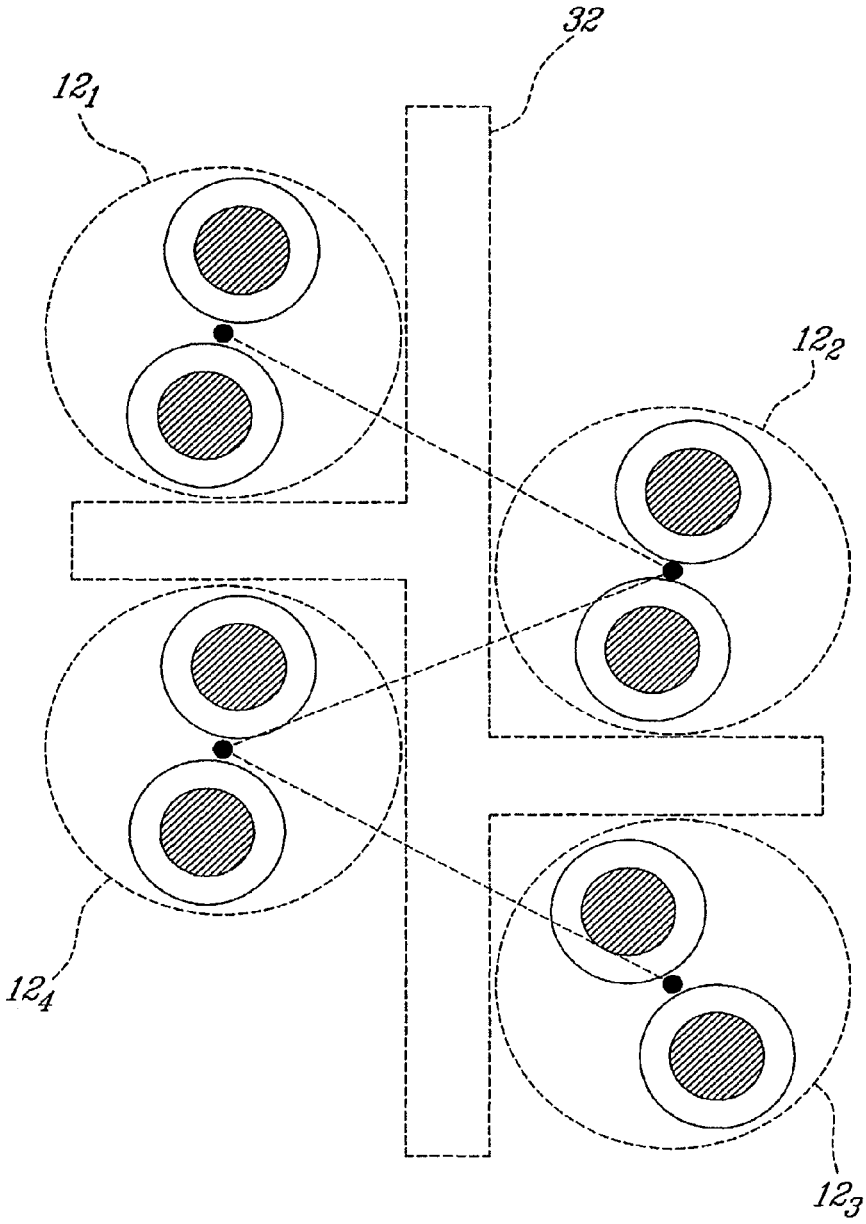

Referring now to FIG. 3C, the asymmetry introduced between the twisted pairs as in 12 by the separator spline 32 can be described in yet another way as follows: The twisted pairs as in 12 and the spline 32 are twisted helically along the length of the cable 10. Twisted pairs $\mathbf{12}_{1A}$ and $\mathbf{12}_{1B}$ are wound helically around a first elongate path, which, when viewed in the transverse cross section of FIG. 3C, is located at point P. Similarly, twisted pairs $\mathbf{12}_{2A}$ and $\mathbf{12}_{2B}$ are wound helically around a second elongate path, which when, viewed in the transverse cross section of FIG. 3C, is located at point Q. The radius $R_2$ of the helically wound twisted pairs $\mathbf{12}_{2A}$ and $\mathbf{12}_{2B}$ is greater than the radius $R_1$ of the helically wound twisted pairs $\mathbf{12}_{1A}$ and $\mathbf{12}_{1B}$ and as a result twisted pairs $\mathbf{12}_{1A}$ and $\mathbf{12}_{1B}$ are shielded to some degree by twisted pairs $\mathbf{12}_{2A}$ and $\mathbf{12}_{2B}$. In order to additionally improve the ANEXT, twisted pairs $\mathbf{12}_{1A}$ and $\mathbf{12}_{1B}$ have longer twist lays than $\mathbf{12}_{2A}$ and $\mathbf{12}_{2B}$.

Still referring to FIG. 3C, of additional note is that if the thicknesses of the first subsidiary dividing strip 42 and the second subsidiary dividing strip 44 are the same, then the elongate first and second paths coincide (i.e. P would be superimposed on Q or vice versa). Alternatively, i.e. if the thicknesses of the first subsidiary dividing strip 42 and the second subsidiary dividing strip 44 are different, the first elongate path followed by twisted pairs $\mathbf{12}_{1A}$ and $\mathbf{12}_{1B}$ winds helically around the second elongate path followed by twisted pairs $\mathbf{12}_{2A}$ and $\mathbf{12}_{2B}$.

Referring now to FIG. 3D, the asymmetry introduced between the twisted pairs as in 12 by the separator spline 32 (in particular where the spline 32 is generally of even thickness) can be described in yet another way as follows: when the cable 10 is viewed in transverse cross section as in FIG. 3D, the distance between twisted pairs $\mathbf{12}_1$ and $\mathbf{12}_2$ twisted pairs $\mathbf{12}_2$ and $\mathbf{12}_4$ and twisted pairs $\mathbf{12}_4$ and $\mathbf{12}_3$ is less than the distance between twisted pairs $\mathbf{12}_1$ and $\mathbf{12}_3$ and greater than the distance between twisted pairs $\mathbf{12}_1$ and $\mathbf{12}_4$ and twisted pairs $\mathbf{12}_2$ and $\mathbf{12}_3$.

One advantage of the above discussed asymmetry, or staggered configuration, versus a conventional cable where the twisted pairs are arranged symmetrically, can be described as follows: In a conventional cable, there exists four (4) adjacent combinations of twisted pairs and two (2) opposite (or diagonal) combinations. Since the adjacent twisted pairs are closer in proximity, the twist deltas (i.e. the ratio between the twist lay of the twisted pairs) between these twisted pairs must be greater than the opposite twisted pairs in order to meet crosstalk requirements. As a result, a conventional cable design requires four (4) aggressive pair twist deltas and two (2) less aggressive pair twist deltas to meet crosstalk requirements. The staggered configuration as described hereinabove above provides that the twisted pair orientations in space allow for the use of only two (2) aggressive pair twist deltas—the remaining twist deltas (4) requiring less aggressive deltas. In other words, the staggered configuration as described allows generally for the use of more relaxed twist deltas and is the opposite of conventional twisted pair design. The benefits include reduced insulation thickness adjustments, reduced skew, better matched attenuation, amongst others.

The addition of such a spline 32 provides various performance benefits with regards to reduction of ANEXT between adjacent cables. Firstly, the incorporation of spline 32 allows for the generation of a helically varying cable cross section, as discussed above with reference to the FIGS. 2A to 2C, that allows greater separation between the twisted pairs of adjacent cables. Though in transverse cross section the twisted pairs remain centrally symmetric about the primary axis 26, by controlling the strand lay, whether keeping it fixed, variable or randomized, the oblong cable transverse cross section will still be helically rotated about the primary axis 26, thereby producing a helically rotating cable cross section that can ultimately reduce nesting and ANEXT.

In addition, the spline 32 also provides the ability to control the internal and external juxtaposition of twisted pairs as in 12. For instance, twisted pairs with longer twist lays are generally more susceptible to NEXT and ANEXT. Though NEXT may be substantially balanced out and compensated for using appropriate connectors and compensation techniques, as discussed above ANEXT generally remains harder to address. Consequently, it is often appropriate to keep twisted pairs with longer twist lays closer together within a same cable, to allow twisted pairs with shorter twist lays to be placed towards the outside of the cable 10, the latter generating reduced ANEXT in adjacent cables than the former. Therefore, referring back to FIG. 3A, the twisted pairs $\mathbf{12}_{1A}$ and $\mathbf{12}_{1B}$, at a closer distance $D_1$ to the primary axis 26 of the cable 10 and forming a first set of twisted pairs, should have longer twist lays than twisted pairs $\mathbf{12}_{2A}$ and $\mathbf{12}_{2B}$ at a further distance $D_2$ to the primary axis 26 of the cable 10 and forming a second set of twisted pairs. As such, ANEXT can be reduced since the twisted pairs $\mathbf{12}_1$ with longer twist lays are kept at a further distance from long twist lay pairs of adjacent cables.

Figure 4:
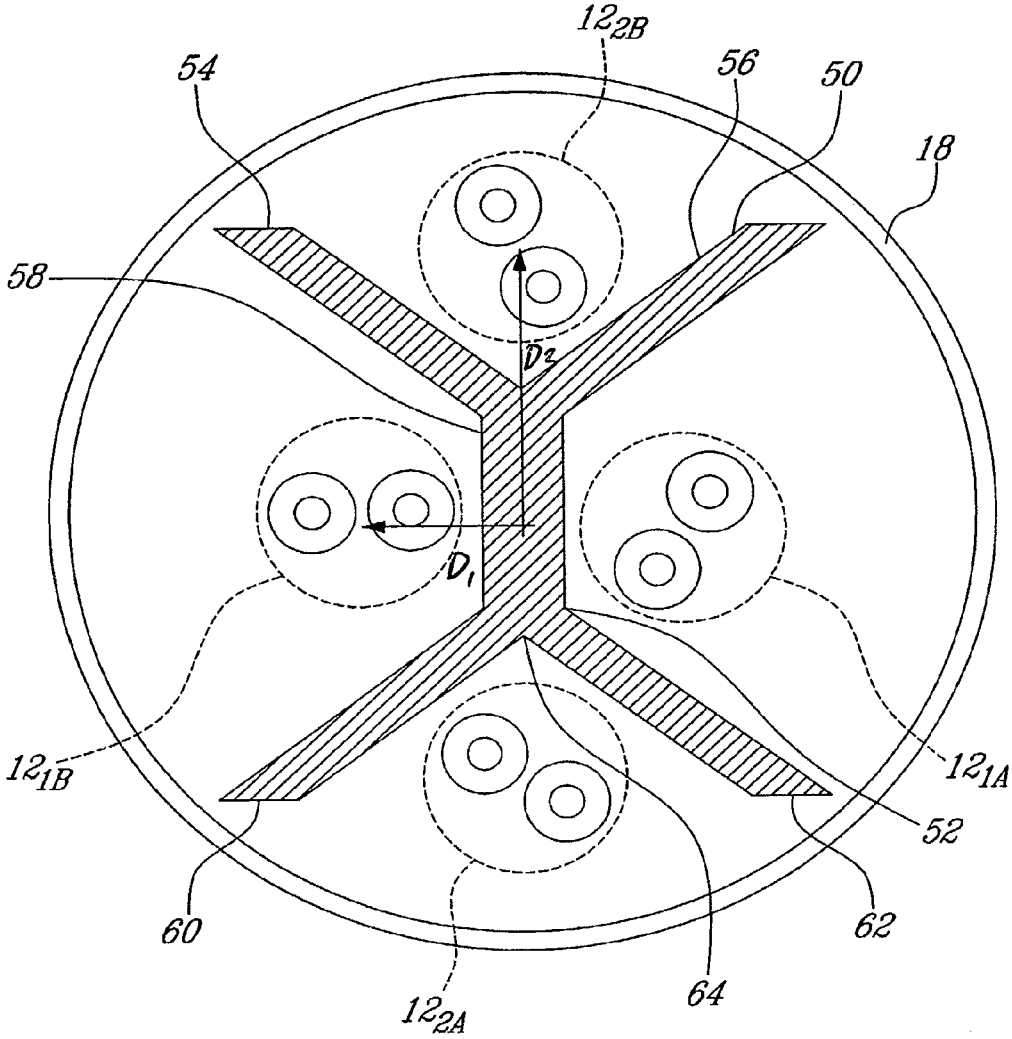
FIG. 4 is a transverse cross section of a cable having a spline therein in accordance with alternative illustrative embodiments of the present invention.

Referring now to FIG. 4, an alternative separator spline 50 in accordance with an alternative embodiment of the present invention is disclosed. In FIG. 4, the separator spline 50 is again defined by five (5) dividing strips. Contrarily to the staggered disposition of spline 32, separator spline 50 is defined by the end-to-end juxtaposition of two Y-shaped dividers. In other words, a middle dividing strip 52 branches off into two angled subsidiary strips 54 and 56 at a first end 58 thereof and branches off into two opposing subsidiary strips 60 and 62 at a second end 64 thereof, thereby again providing four (4) compartments or channels within which may be disposed the individual twisted pairs 12. Similar to the cable of FIG. 3A, the twisted pairs $\mathbf{12}_{1A}$ and $\mathbf{12}_{1B}$ of longer twist lays are again at a generally closer distance $D_1$ to the primary axis 26 of the cable 10, and the twisted pairs $\mathbf{12}_{2A}$ and $\mathbf{12}_{2B}$ of shorter twist lays are again at a generally further distance $D_2$ to the primary axis 26 of the cable 10. Consequently, ANEXT can again be reduced since the twisted pairs $\mathbf{12}_1$ with longer twist lays are kept at a further distance from long twist lay pairs of adjacent cables.

Figure 5A:
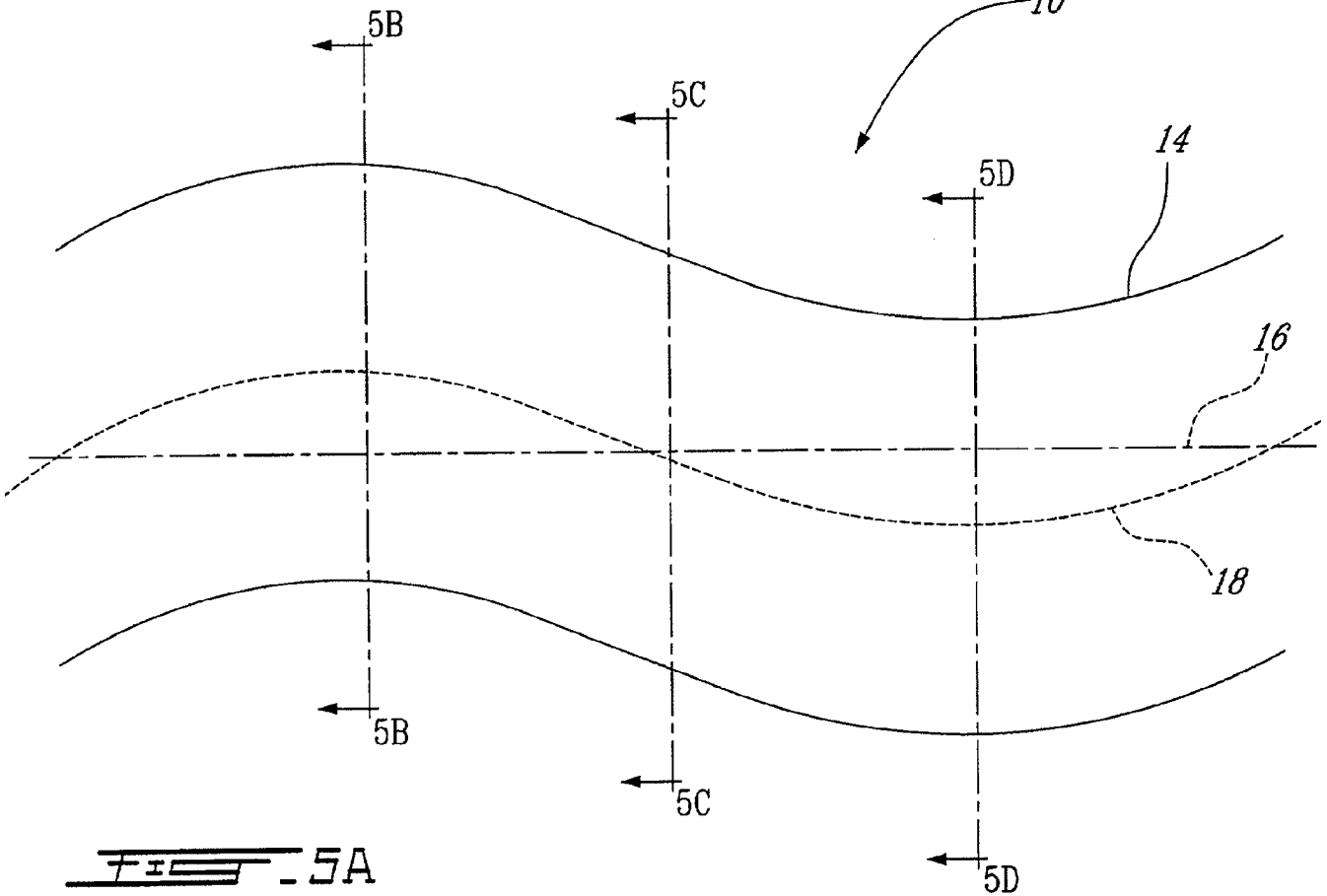
FIG. 5A presents a side view of a cable in accordance with an illustrative embodiment of the present invention.
Figure 5B:
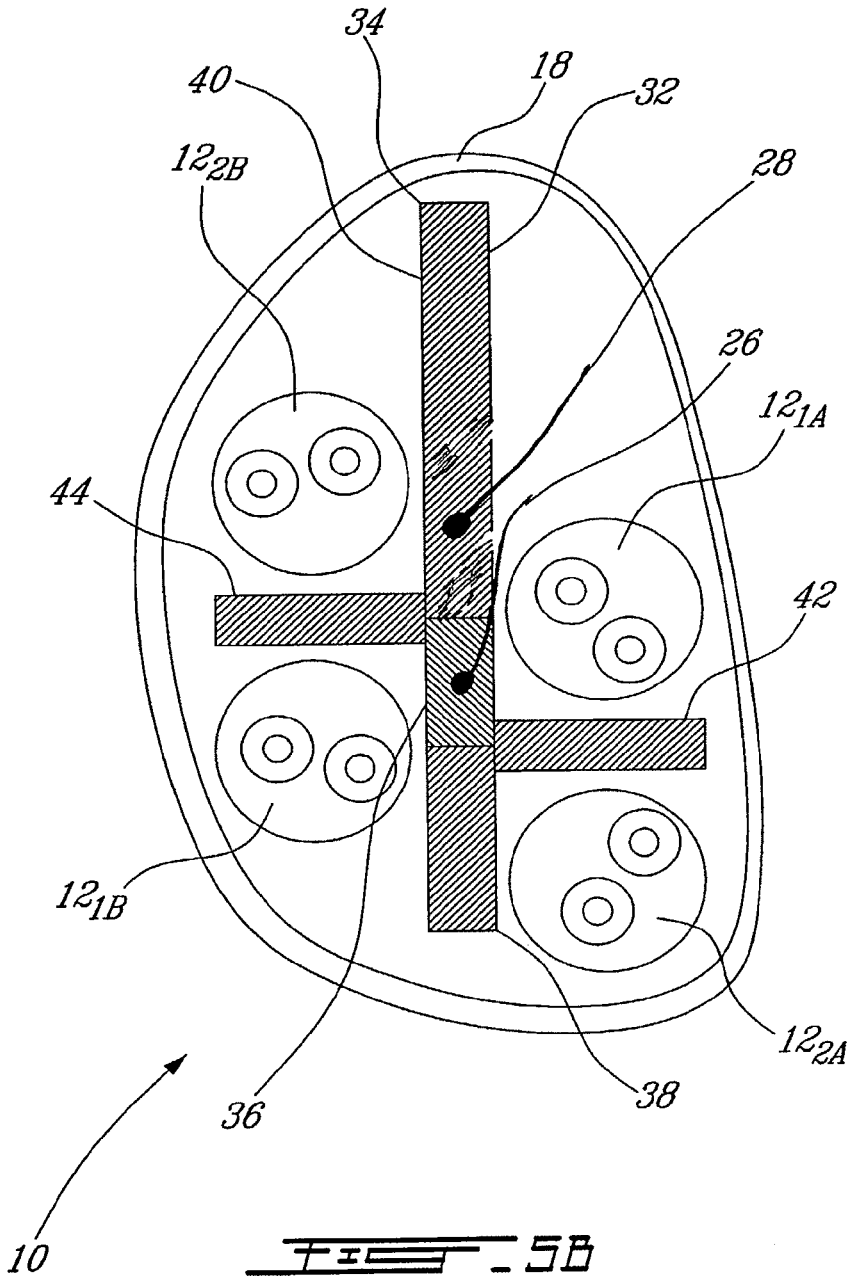
FIGS. 5B, 5C and 5D are subsequent transverse cross sections of the cable along 5B-5B, 5C-5C and 5D-5D in FIG. 5A.
Figure 5C:
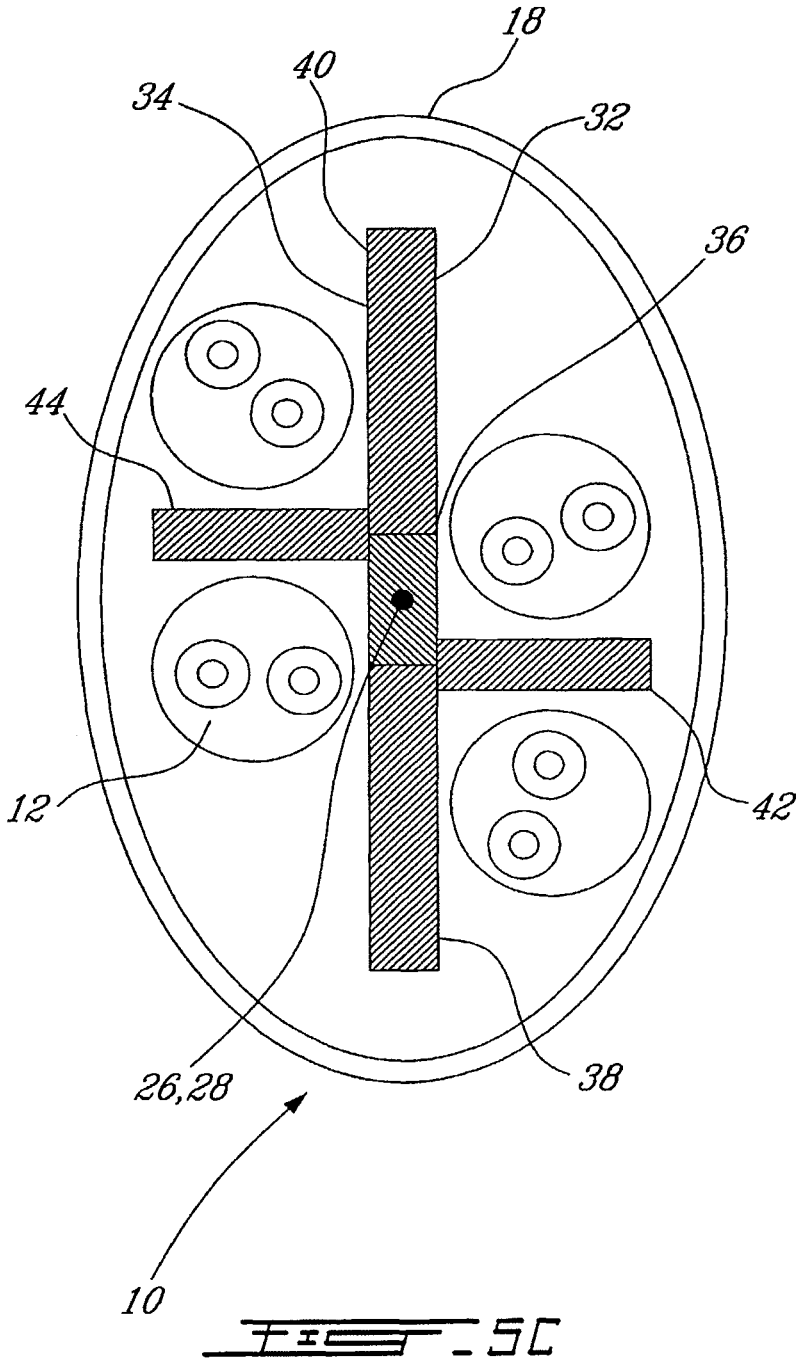
Figure 5D:
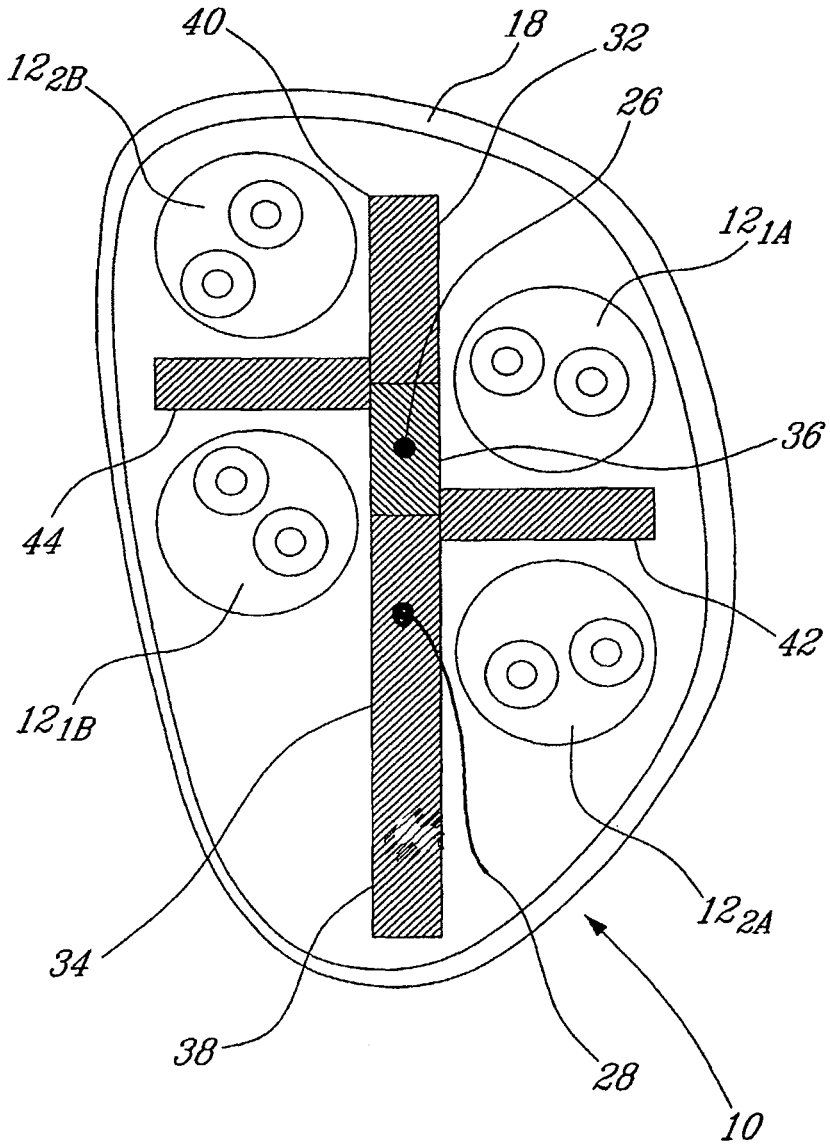

Referring now to FIGS. 5A to 5D in conjunction with FIG. 3A, and in accordance with an alternative illustrative embodiment of the present invention, the cable 10 is manufactured such that the lengths of the various strips (36, 38, 40) of spline 32 may vary along the length of the cable 10. This will not only allow the cable to maintain isolation of the twisted pairs 12, but will also provide a means for generating an asymmetric distribution of the twisted pairs between adjacent cables, improving ANEXT effects therebetween. Illustratively, if a cross section of the cable 10 of FIG. 5A is taken at subsequent steps 5B, 5C and 5D along the cable, one observes, as correspondingly illustrated in FIGS. 5B to 5D that the length and position of the individual strips may vary along the length of the cable 10. Namely in FIG. 5B, the outer strip 40 of principal strip 34 is longer than the outer strip 38 of same. In FIG. 5C, both outer strips 38 and 40 are substantially equal, and in FIG. 5D, outer strip 40 is now shorter than outer strip 38. In the illustrated example of FIGS. 5A to 5D, only the lengths of the outer strips 38 and 40 vary such that the centre path 28, defined by the geometrical centre or centroid of the cable, will propagate longitudinally on the main strip 34 along the length of the cable 10.

In this simplified illustrative embodiment, the cable 10 is not twisted during manufacturing to simplify the illustration of the centre path 38 oscillating about the primary axis 26. Generally, as discussed above, the twisted pairs 12 of the cable 10 are twisted within the jacket 18 according to a fixed, variable or random strand lay. Consequently, the illustrated cable would ultimately present a centre path 28 rotating helically about the primary axis 26. Necessarily, a similar affect could be obtained using a static asymmetric spline 32 defining an extruding outer strip, such as strip 40 in FIG. 5B. Furthermore, an extruding element could be coupled to the extremity of such a cross web to amplify the protuberance. Yet, by utilizing a generally asymmetric spline 32, such as illustrated in FIG. 5B, and varyingly adjusting the length of the various strips, as illustrated successively in FIGS. 5B through 5D, a combined effect is obtained. Namely, not only does the cable exhibit a helically rotating cross section asymmetry, the twisted pairs as in 12 most exposed to external perturbations, i.e. the twisted pairs disposed about the shortest outer dividing strip ($\mathbf{12}_{1B}$ and $\mathbf{12}_{2A}$ about outer strip 38 in FIG. 5B, $\mathbf{12}_{2B}$ and $\mathbf{12}_{1A}$ about outer strip 40 in FIG. 5D), varies with the variable dimensions of the spline 32, which may vary fixedly, variably, or randomly.

Alternatively, the lengths of the strips may vary helicoidally rather than linearly, the lengths of the outer strips 40 and 38 and subsidiary strips 42 and 44 each cyclically becoming shorter and longer in a helical fashion as the cable 10 is fabricated. As above, the centre path 28 will travel helically along the cable length with a fixed, variable or random lay defined by a combination of the strip shortening and lengthening rates and the cable strand lay. As the cable is fabricated, the helically rotating asymmetry will again lead to reduced nesting and improved ANEXT ratings while providing the additional feature presented hereinabove, that is to vary the positioning of twisted pairs 12 within the cable 10 with regards to the extrusion or protuberance generated by the asymmetric spline 32.

Ultimately, the above mechanism is not unlike winding a filler element 16 (such as a rod) or protuberance 30 about the cable primary axis 26 as discussed herein with reference to FIGS. 2A to 2C. As presented in the illustrative embodiments of FIGS. 2A to 2C, the direction of rotation of the helical distortion may be counter to the direct of rotation of the strand lay of the twisted pairs 12. Similarly, the length of the individual dividing strips may be helicoidally varied in a rotational direction opposite to the rotational direction of the strand lay. Randomizing the dividing strip length variation and the strand lay will ultimately produce a fully randomized cable for reducing nesting and ANEXT.

Necessarily, though the illustrated embodiments described above with reference to FIGS. 5A to 5D benefit from the configuration of a staggered separator spline as in 32, other splines, namely alternative spline 50 of FIG. 4 may also provide beneficial improvements when variable strip lengths are applied thereto. For instance, a simple X-shaped spline comprising two intersecting dividing strips, the intersection being possibly defined by right angles or by any angles suitable to provide separate compartments for the individual twisted pairs, could also be used in this cabling process. For example, the intersection point between the two dividing strips provides a primary axis and the centroid or geometrical centre of the spline or cable again provides a centre path as defined hereinabove. By sequentially varying the lengths of the individual segments of the X-shaped spline along the length of the cable, the centre path will rotate helically about the primary axis thereby generating a helicoidally varying cable cross section asymmetry that reduces cable nesting and ANEXT between adjacent cables.

Figure 6A:
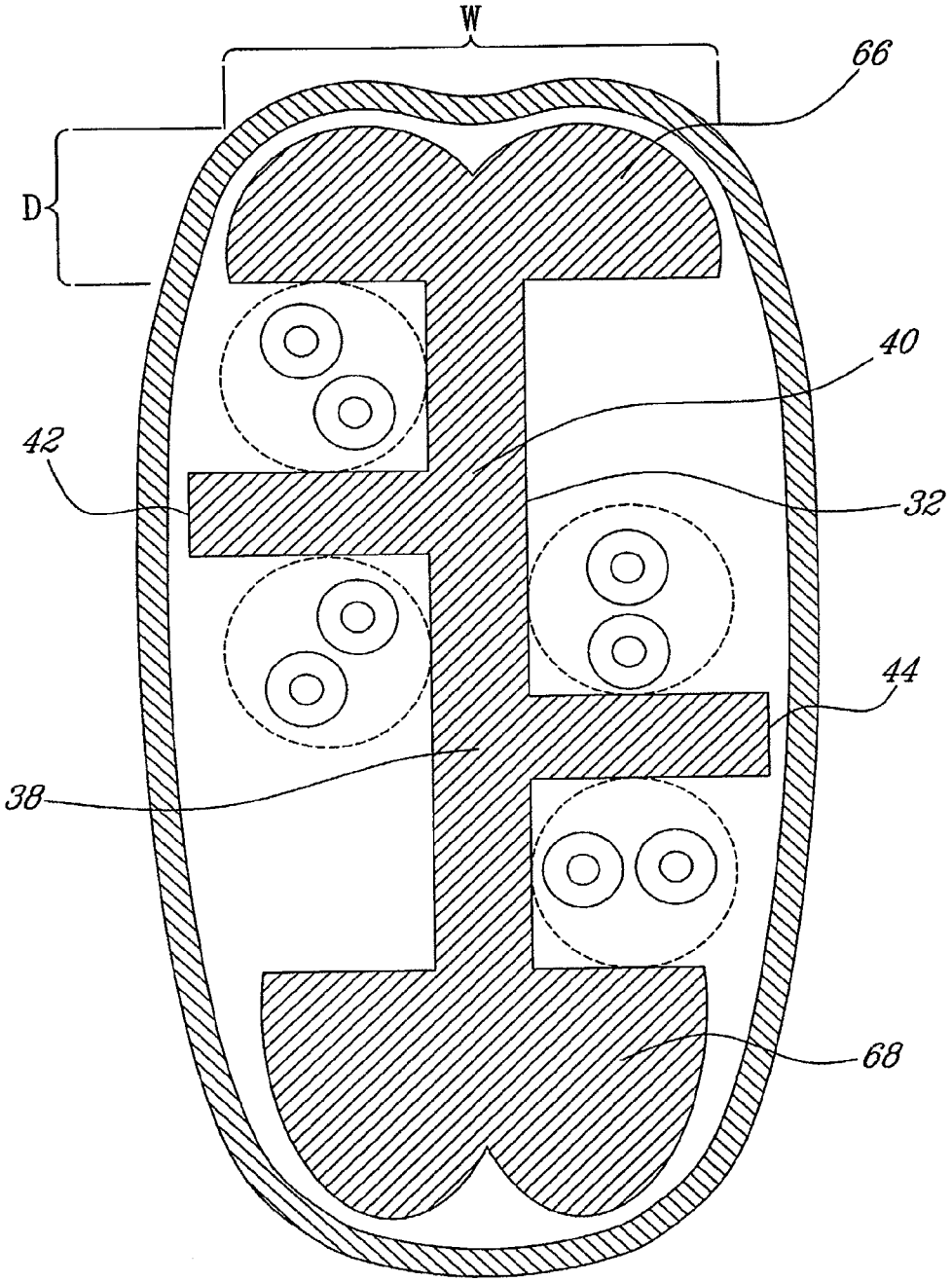
FIGS. 6A and 6B are transverse cross sections of cables and splines in accordance with alternative illustrative embodiments of the present invention.
Figure 6B:
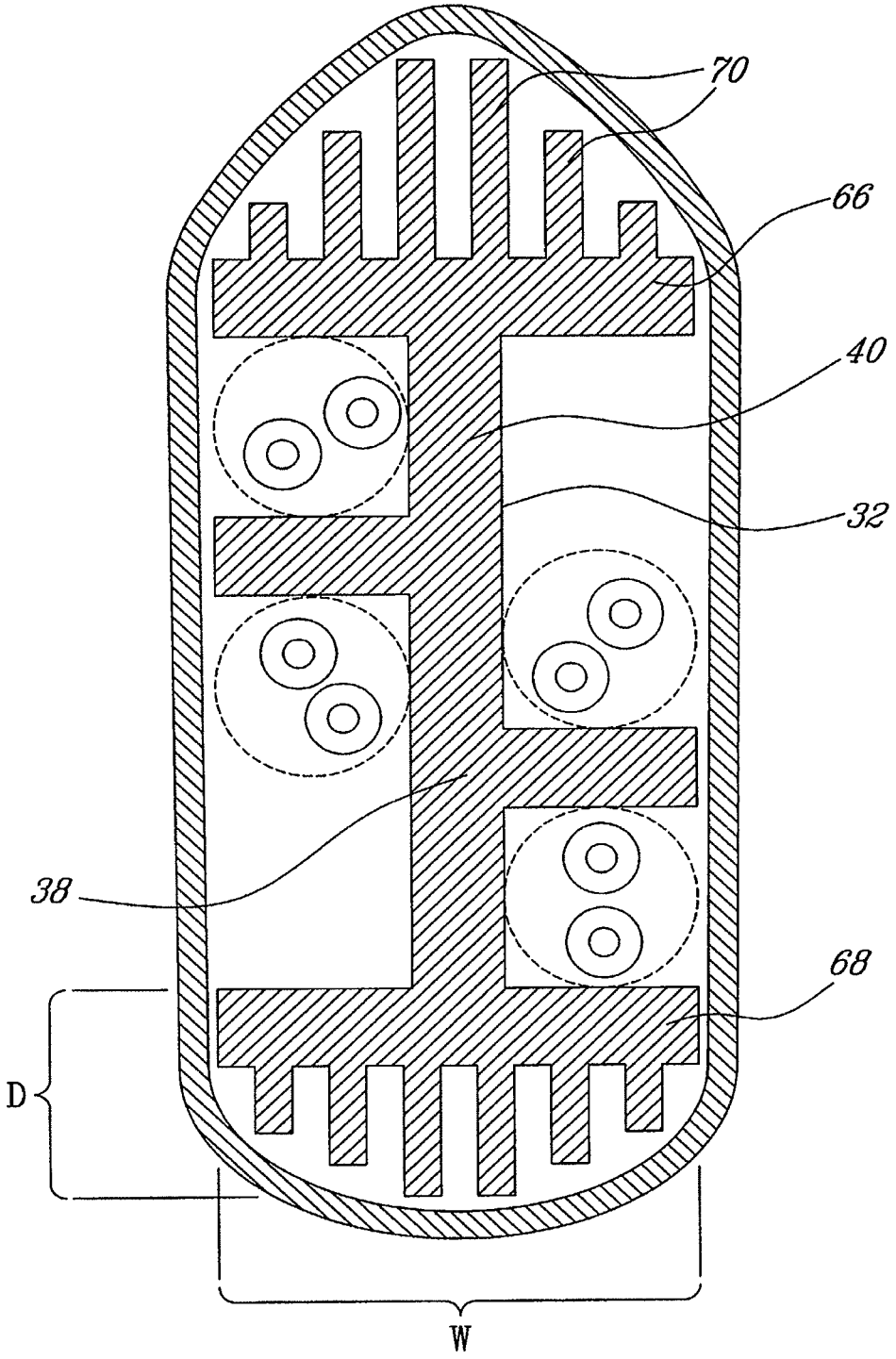

Referring now to FIGS. 6A and 6B in another alternative illustrative embodiment the spline 32 includes first and second protrusions 66, 68, illustratively attached at right angles towards the ends of the first outer strip 40 and the second outer strip 38. Alternatively, such protrusions as in 66, 68 can be attached to the ends of one or other or both of the first and second subsidiary dividing strips 42, 44. In this regard, if such a protrusion is attached to only one of the subsidiary dividing strips as in 42, 44, or one of the protrusions is larger, it is preferable that the (larger) protrusion be attached to the end of the subsidiary dividing strip as in 42, 44 adjacent to the twisted pair 12 having the longest twist lay. Referring to FIG. 6A these filler elements can be solid or referring to FIG. 6B comprised of a series of segments 70. Additionally, the filler may vary in thickness D or width W, either periodically to preset values or randomly.

Figure 7:
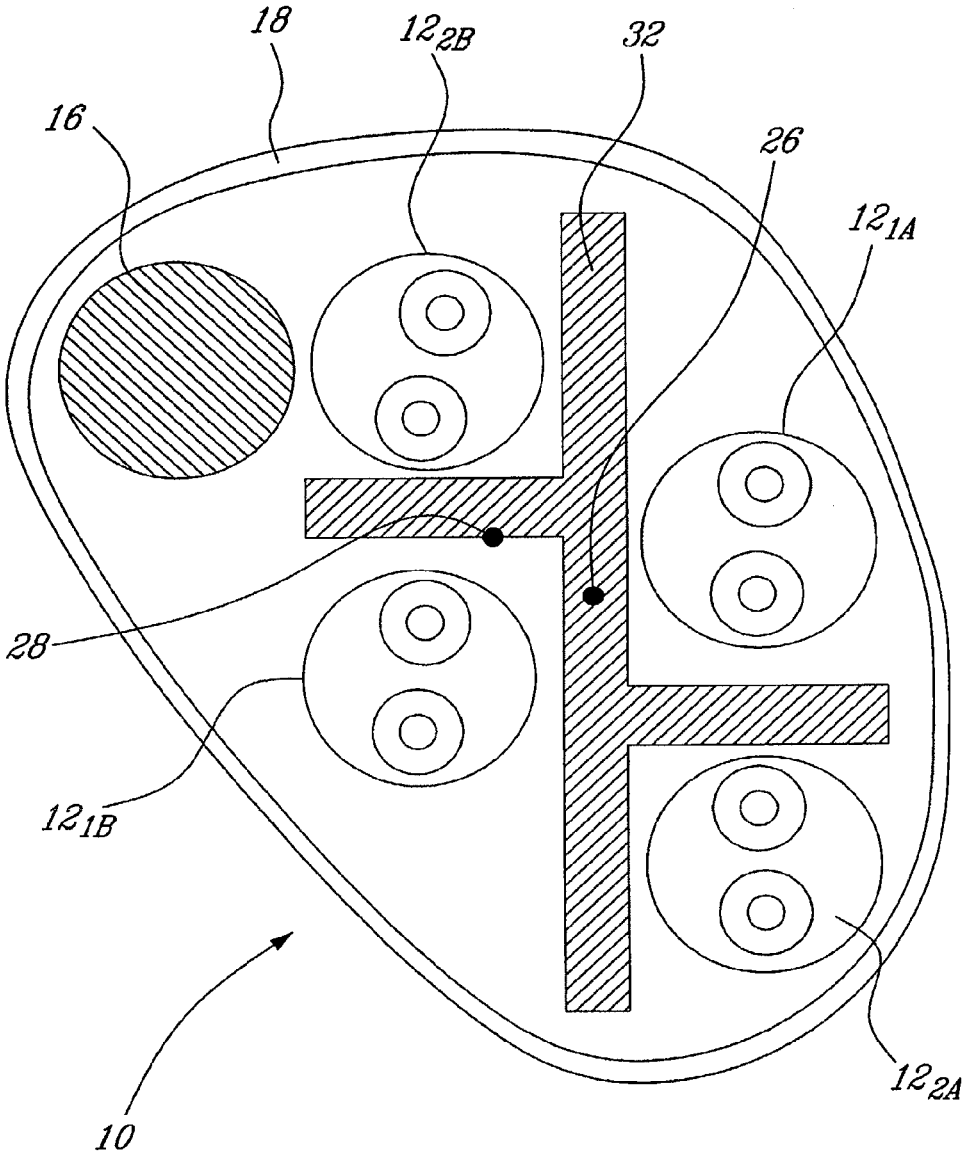
FIG. 7 is a transverse cross section of a cable having a spline and a filler element therein in accordance with an illustrative embodiment of the present invention.

Referring now to FIG. 7, in yet another alternative illustrative embodiment of the present invention, and in order to further improve PSANEXT reduction, the four twisted pairs of conductors as in 12 are separated by a spline as in 32 and wound with a filler element 16. The assembly is covered in a cable jacket 18. Illustratively, the filler element 16 is again manufactured from a non-conductive dielectric material such as plastic or the like, in either a solid or stranded form. As a consequence, the cable 10 benefits from the incorporation of the spline 32 and all its attributes (discussed extensively hereinabove with reference to FIGS. 1 and 3 to 5D) as well as benefits from the helicoidally rotating asymmetry provided by the filler element 16 and all its attributes (discussed extensively hereinabove with reference to FIGS. 1 and 2A to 2C). The combination of some or all of the above techniques for reducing nesting and ANEXT between adjacent cables, namely variable or randomized laying techniques and opposite twist, strand and protuberance helicities to name a few, can thus be implemented in this illustrative embodiment.

Figure 8:
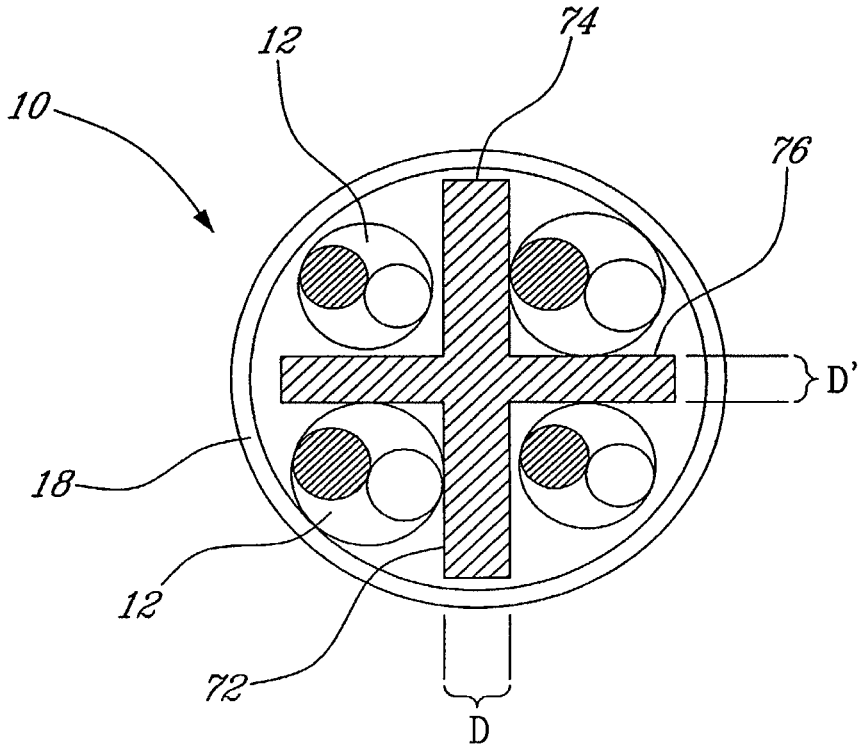
FIG. 8 is a transverse cross section of a cable having an asymmetric separator spline therein in accordance with an alternative illustrative embodiment of the present invention.

Referring now to FIG. 8, in still yet another alternative illustrative embodiment of the present invention, a cable 10 comprised of four (4) twisted pairs of conductors as in 12 is surrounded by a cable jacket 18 and separated by an alternative asymmetric separator spline 72 is disclosed. The alternative spline 72 is of an asymmetric design where the first and second strips 74 and 76 of the cross section of the X-shaped spline 72 are of different thickness D and D'. Necessarily, variations in spline thicknesses either in part or as a whole can be applied to the other illustrative embodiments of the present disclosure to improve ANEXT effects.

In order to measure the ANEXT, and therefore the effects particular cable configurations have on PSANEXT, a test scenario comprised of one victim cable as in 10 surrounded by six (6) other offending cables was used. A test scenario comprising seven (7) cables comprising the asymmetrical separator spline as discussed hereinabove with reference to FIGS. 3, 5 and 6 was found to reduce PSANEXT of the victim cable. In the embodiment of FIG. 8, though the variable spline thicknesses help reduce unwanted cross talk, the incorporation of the filler element 16 of FIG. 8 does not appear to provide the same level of reduction of PSANEXT. Apparently, the incorporation of the filler element 16 and the spline 32 improves PSANEXT mitigation by increasing the distance between the victim cable and the six offending cables.

Additionally, improvements in PSANEXT reduction may be obtained by longitudinally randomizing the twist lays and the strand lay of the twisted pairs, or core, in a gang mode. Thus the randomization is performed simultaneously on all twisted pairs in order to maintain the internal twist lay ratios intact. This latter requirement helps to ensure that adequate internal cable NEXT parameters are maintained. One way to effect the randomization of the twist lays is by changing the strand lay randomly along the length of the cable. This method affects both the strand lay and the twist lay, albeit to a lesser degree.

The randomization of twist lays, the strand lay, or both serve to mitigate PSANEXT on a victim cable by eliminating the repetition inherent in the like pairs along the cable length. A similar effect is obtained by randomizing the pitch, or lay, of the filler element 16 along the cable 10. Such randomization reduces the nesting between adjacent cables and, consequently, further increases the distance between a victim cable and the offending cables.

The incorporation of a fluted filler element 16 and also the separator spline additionally contributes to a lowering of the overall rigidity of the cable due to a reduction in the mechanical rigidity of the assembly, thereby providing for a more pliant or flexible cable. In addition, the introduction of a filler element 16 between the jacket 18 and the twisted pairs 12 reduces the overall attenuation due to increased air space in the cable. In another preferred enhancement of the above disclosure, the cable jacket 18 is striated or fluted along the inner surface 22 in contact with the twisted pairs 12 in order to also reduce the overall attenuation of the cable 10. This is achieved largely by the creation of additional air space between the twisted pairs as in 12 and the jacket 18.

Although the present invention has been described hereinabove by way of an illustrative embodiment thereof, this embodiment can be modified at will without departing from the spirit and nature of the subject invention.

What is claimed is:

1. A telecommunications cable comprising:

a plurality of twisted pairs of conductors arranged around and running along an axis; and a cable jacket surrounding the plurality of twisted pairs, the jacket comprising a substantially circular outer surface and a substantially circular inner surface, wherein the inner surface and the outer surface are not concentric, and wherein the outer surface defines a tube having a helical centre path arranged around and running along the axis.

2. The telecommunications cable of claim 1, wherein a pitch of the helical centre path along the axis is random.

3. The telecommunications cable of claim 1, wherein the inner surface of the jacket is substantially parallel and collinear with the axis.

4. The telecommunications cable of claim 1, wherein the center path is at a geometrical center of the telecommunications cable.

5. The telecommunications cable of claim 1, further comprising a spline separating each of the plurality of twisted pairs.

6. A telecommunications cable comprising:

a plurality of twisted pairs of conductors arranged helically around and running along a first axis; and a cable jacket surrounding the plurality of twisted pairs, the cable jacket comprising a single protrusion arranged around and running along the cable jacket, wherein the single protrusion is arranged helically around the first axis; and wherein the single protrusion twists helically around the first axis in a direction opposite to that of the plurality of twisted pairs.

7. The telecommunications cable of claim 6, wherein the single protrusion runs along an outer surface of the cable jacket.

8. The telecommunications cable of claim 6, wherein a pitch of the helical twist of the protrusion along the first axis is random.

9. The telecommunications cable of claim 6, further comprising a spline separating each of the plurality of twisted pairs.

10. The telecommunications cable of claim 6, wherein the protrusion has a substantially semi-circular cross-sectional shape.

11. A telecommunications cable comprising:

a spline comprising a central portion and two side portions, the two side portions arranged on opposite sides of the central portion and offset from one another;

a first set of two twisted pairs of conductors arranged on opposite sides of and running along the central portion of the spline and separated by a first distance; and a second set of two twisted pairs of conductors on opposite sides of and running along the central portion of the spline and separated by a second distance less than said first distance;

wherein each of said first set of twisted pairs has a twist lay which is shorter than a twist lay of either of said second set of twisted pairs.

12. The telecommunications cable of claim 11, further comprising:

a cable jacket surrounding the first and second sets of twisted pairs and the spline; and an elongate filler element wound helically about the first and second sets of twisted pairs underneath the jacket.

13. The telecommunications cable of claim 12, wherein the first and second sets of twisted pair are wound helically about a central axis of the telecommunications cable; and wherein a direction of helical rotation of the elongate filler element about the twisted pairs is opposite to a direction of helical rotation of the twisted pairs about the central axis.

14. The telecommunications cable of claim 11, wherein the two side portions of the spline are attached approximately perpendicular to the central portion.

15. A telecommunications cable comprising:

a plurality of in parallel twisted pairs of conductors, wherein each of the twisted pairs has a constant twist lay and follows a helical path along an axis, the helical path having a variable pitch;

a cable jacket surrounding the twisted pairs; and an elongate filler element wound helically around the twisted pairs underneath the cable jacket, and wherein a direction of rotation of the elongate filler element is opposite to a direction of rotation of the twisted pairs.

16. The telecommunications cable of claim 15, wherein the plurality of twisted pairs consists of four twisted pairs.

17. The telecommunications cable of claim 15, wherein the axis corresponds to a geometrical center path of the telecommunications cable.

18. The telecommunications cable of claim 15, further comprising a spline separating each of the plurality of twisted pairs.

* * * * *